US005171012A

United States Patent [19]

Dooley

[11] Patent Number: 5,171,012

[45] Date of Patent: Dec. 15, 1992

[54] DETECTOR SYSTEM FOR OBJECT MOVEMENT IN A GAME

[76] Inventor: Daniel J. Dooley, 5536 Washington, Downers Grove, Ill. 60516

[21] Appl. No.: 475,144

[22] Filed: Feb. 5, 1990

Related U.S. Application Data

[63] Continuation-in-part of Ser. No. 468,536, Jan. 23, 1990.

[51] Int. Cl.[5] ..... A63F 9/22; A63F 9/24

[52] U.S. Cl. ..... 273/85 G; 273/2; 273/437; 273/108; 273/118 A; 273/DIG. 28

[58] Field of Search ..... 340/725, 727; 273/85 R, 273/87 R, 88, 86 A, 94 R, 313, 118 A, DIG. 28, 85 G, 2, 437, 108; 352/50, 52, 87

[56] References Cited

U.S. PATENT DOCUMENTS

| | | | |
|---|---|---|---|
| 4,045,789 | 8/1977 | Bristow | 340/725 |
| 4,343,469 | 8/1982 | Kunita et al. | 273/DIG. 28 |
| 4,346,892 | 8/1982 | Kitchen et al. | 273/313 |
| 4,580,782 | 4/1986 | Ochi | 273/1 E |
| 4,872,687 | 10/1989 | Dooley | 273/185 R |
| 4,893,182 | 1/1990 | Gautraud et al. | 273/63 D |
| 4,952,051 | 8/1990 | Lovell et al. | 340/725 |

FOREIGN PATENT DOCUMENTS

| | | | |
|---|---|---|---|
| 2416510 | 10/1979 | France | 273/DIG. 28 |

OTHER PUBLICATIONS

"Right Down the Alley", *Playmeter*, Jun. 15, 1979, vol. 5, #11, p. 78.

Jul. 1988 issue of *Play Meter* Magazine, p. 35.

Aug. 15, 1986 issue of *Play Meter* Magazine, p. 57.

*Primary Examiner*—Vincent Millin

*Assistant Examiner*—Jessica J. Harrison

*Attorney, Agent, or Firm*—Gregory B. Beggs

[57] ABSTRACT

Movements of bowling balls, pool balls and similar objects are simulated in game or other environments by generating indications on a CRT screen in timed and spaced relation to represent the shape of an object, paths of movement of the object, rotations of the object and collisions of the object with other objects in a manner such as to provide the viewer with perceptions of such movements which are generally realistic and highly attractive.

9 Claims, 9 Drawing Sheets

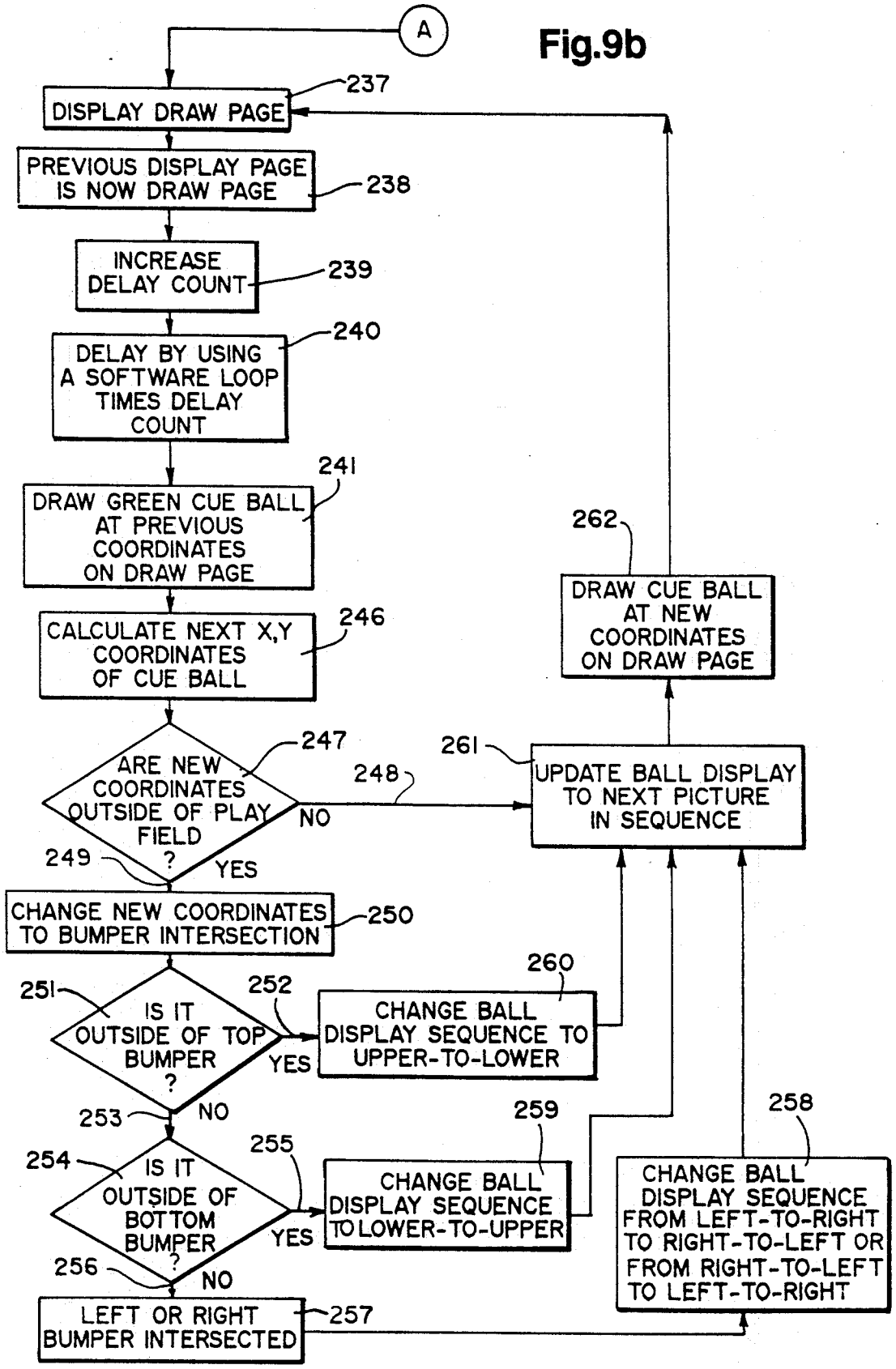
Fig.9b
A
DISPLAY DRAW PAGE
237
PREVIOUS DISPLAY PAGE IS NOW DRAW PAGE
238
INCREASE DELAY COUNT
239
DELAY BY USING A SOFTWARE LOOP TIMES DELAY COUNT
240
DRAW GREEN CUE BALL AT PREVIOUS COORDINATES ON DRAW PAGE
241
CALCULATE NEXT X,Y COORDINATES OF CUE BALL
246
ARE NEW COORDINATES OUTSIDE OF PLAY FIELD ?
247
NO
248
YES
249
CHANGE NEW COORDINATES TO BUMPER INTERSECTION
250
IS IT OUTSIDE OF TOP BUMPER ?
251
YES
252
NO
253
CHANGE BALL DISPLAY SEQUENCE TO UPPER-TO-LOWER
260
IS IT OUTSIDE OF BOTTOM BUMPER ?
254
YES
255
NO
256
CHANGE BALL DISPLAY SEQUENCE TO LOWER-TO-UPPER
259
LEFT OR RIGHT BUMPER INTERSECTED
257
CHANGE BALL DISPLAY SEQUENCE FROM LEFT-TO-RIGHT TO RIGHT-TO-LEFT OR FROM RIGHT-TO-LEFT TO LEFT-TO-RIGHT
258
UPDATE BALL DISPLAY TO NEXT PICTURE IN SEQUENCE
261
DRAW CUE BALL AT NEW COORDINATES ON DRAW PAGE
262

DETECTOR SYSTEM FOR OBJECT MOVEMENT IN A GAME

REFERENCE TO RELATED APPLICATION

This application is a continuation-in-part of my prior application Ser. No. 468,536, filed Jan. 23, 1990, pending.

COPYRIGHT

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention relates to sports or games generally and more specifically to board, lane or field games wherein objects are rolled or slid over a horizontal plane.

BACKGROUND OF THE INVENTION

An analysis of considerations which relate to games such as those using a Cathode Ray Tube or other type of display is contained in my aforementioned application. As disclosed therein, games involving ball rolling or sliding objects usually involve a player hitting or rolling the ball or sliding object towards a hole or some target. For instance, bowling requires a person to aim a bowling ball down a lane towards a group of pins standing at the far end of the lane. There typically are gutters on both sides of the lane that catch an errant shot and prevent the ball from the lane that catch an errant shot and prevent the ball from contacting any pins. The object of the game is to have the bowling ball knock down as many pins as possible. An advanced technique of putting a spin on the bowling ball so that it curves into the pins allows better bowlers to knock down more pins. Some examples of bowling games are:

(a) Full scale bowling usually entails a specially oiled wooden floor of twenty five feet or more in length. There usually are ten pins, each over a foot tall weighing several pounds. A bowling ball weighing up to 16 pounds is used. The pins that are knocked down have to be cleared and reset into position. The ball has to be returned to the bowler.

(b) Table top versions of bowling may use a scaled down lane, pins and balls. The ball still has to be returned, the pins cleared and reset.

(c) Another table top version uses a sliding disc with contact switches embedded in the lane underneath pins that fold-down from above the lane. There is enough clearance between the pins and the switches for the disc to slide between. When the disc contacts a switch certain pins fold up which relates to knocking down pins in regulation bowling. The bowler does not benefit from spinning the disc. The disc is returned to the bowler by bouncing off a rubber bumper located at the end of the lane.

(d) Video versions of bowling typically display the lane, pins and ball on the monitor. The player uses joy sticks and switches to control the speed, direction and spin of the ball. One variation of the joy stick is a captured ball embedded in the console. When this ball is spun, detectors inside the console encode the rotational movement which is converted by a microprocessor into projected ball movement on the screen.

Each of these devices have certain limitations. The full scale bowling as described in (a) above requires a lot of space and a sizeable monetary expense for the equipment. Repairs and maintenance for the pin setting and ball return mechanisms and the lane upkeep are needed constantly.

The scaled down bowling game as described in (b) above requires that the pins be cleared and set. In most cases, the way that the pins react to the ball striking them does not duplicate the way it happens in the full scale bowling version.

The sliding disc table top version as described in (c) above limits the problems of pin clearing and setting. However, there are many moving parts which leads to constant breakdown from wear and tear. The aiming and sliding of the disc does not simulate the motion of throwing the full scale bowling ball. Spinning, which is used by experienced bowlers in (a) and (b), does not come into play when using a disc. A skilled bowler of full scale bowling is not necessarily a skilled disc bowler.

Video versions as described in (d) above alleviate the problems of pin clearing and setting. These are handled with the game software. Controlling the ball speed, direction and spin with joy sticks, spinning balls and switches does not simulate the motion of throwing the full scale bowling ball. Eye-hand coordination and finger dexterity are required to be skillful with joy sticks, spinning balls and switches. The rhythmic, pendulum swing of a typical bowler does not come into play at all. A skilled bowler of full scale bowling is not necessarily a skilled manipulator of joy sticks, spinning ball and switches.

In applicant's recently issued U.S. Pat. No. 4,872,687 a sensor arrangement is disclosed which effectively measures variations in roll patterns from a reference line for games such as golf, pool or the like involving movement across a horizontal plane. The ball or object generally, although not necessarily, starts at a point along the reference line.

In certain variations of these and other games it is often desired that the ball or object start from a variety of positions. Moreover, in many of these variations the moving object may travel in a path which is not a straight, e.g. a "hooked" path as in bowling.

It is a general object of the invention of my aforementioned prior application to provide a movement detection system that operates independent of the starting point for the object moving.

It is a related object of the invention of my aforementioned prior application to provide a detection system that senses movement in a path that may be other than a straight line.

It is a more specific object of the invention of my aforementioned prior application to provide a game system that measures object paths without moving parts or complicated mechanical or electromechanical sensors.

This invention has the general object of providing forth improvements, particularly with regard to realistically displaying movements of balls or the like.

SUMMARY OF INVENTION

The foregoing objects are provided in an interface that would allow any game that propels a rolling or sliding object towards a target to be merged with a video display while still using the typical motions and devices to propel the object. Means are provided to accurately determine the speed and direction of the propelled object accurately with a non-intrusive means. Key components involved in determining direction are the position of the propelled object in relation to the center position, the angle of the propelled object's path and any curving nature of the propelled object's path. Path detection is achieved by pairs of optical detectors arranged for scanning the object plane. Two pair of such detectors detect straight line movement independent of origin, while a third pair of such detectors measures curved path movement.

The preferred embodiment of the invention illustrates the application of the detection means as used in a bowling game. One variation of the preferred embodiment is the disc sliding bowling. This version does not require the determination of any curving component of the disc's path.

Another version of the preferred embodiment incorporates a shortened full-scale bowling lane. The bowler uses a standard bowling ball. Instead of actual bowling pins being at the end of the lane, there is a video monitor that would have displayed a graphical representation of the bowling pins. At the end of the bowling lane where actual pins would normally be positioned, there is a sensor housing. It is large enough for an actual bowling ball to roll through and it has the sensors positioned at ½ the height of the actual bowling ball.

The invention is readily applied to games using a cue ball as the propelled object, such as pocket billiards, snooker, billiards, bumper pool, and many other varieties. A regular cue ball and cue stick is preferably used in order to retain the "feel" of the game. A short runway covered with felt serves as the surface where the cue ball is positioned to be struck by the cue. A video monitor is placed just above and beyond the sensor housing. The cue ball is aligned with a spot on the video monitor and it is propelled towards the video monitor, rolling through the sensor housing. A return chute is positioned at the end of the sensor housing which returns the cue ball to the pool player. The speed, direction and path information is detected, calculated and output to video control circuitry.

The information may be utilized in a variety of ways. In the preferred embodiment, the video control circuitry translates it to a display of the cue ball on the screen following the same relative path position, movement and speed. The displayed, moving ball continues until it hits a bumper, another pool ball or goes into a pocket, depending upon the design of video displayed game.

Skee ball is another game that readily adapts to the application of the invention. Skee ball is basically a game where a ball is rolled toward a tilted target of circular containers, smaller containers inside larger ones until the final centered container is not much larger than the diameter of the ball. The object is to get the ball to roll up a ramp into the middle small containers which score more points than the larger containers.

A skee ball game incorporating the application of the invention could have as one version a shortened ramp similar to a skee ball ramp. Instead of having the actual circular targets, there is a video monitor where the skee ball circular targets is graphically represented. The skee ball rolls towards the video monitor and passes through a sensor housing. The ball movement is detected, analyzed and converted to a form acceptable by the video control circuitry, which then projects a moving ball onto the video monitor.

Shuffleboard is another game that readily adapts to the application of the invention. Shuffleboard is a game in which a disc-like object is propelled from one end of a lane to the other ( a length of approximately 20 feet ) with a pushing motion on a stick that cradles the disc. A shorter, table version using hand-propelled metal discs is also popular. The object is to have the disc push an opponent's discs off of designated point areas and or have the propelled disc stop inside a designated point area.

The shuffleboard game that has the invention incorporated into it could have as versions a full scale version or some scaled table top version. In the full scale version, a flooring representing the shuffleboard lane is used but it is not as long as the typical shuffleboard lane. There is only one end with designated point areas, and this end has a video monitor present and a sensor housing that allows the sliding disc to travel through. The scaled table version is similar but the lane is elevated and a smaller disc and shuffleboard stick are used. In all of these games a suitable ball or object return mechanism can be provided by one skilled in the art.

The variety of games possible with the present invention is endless. Marbles is another example of a game that can use the application of the invention.

The present invention incorporates a graphics means which realistically displays a rolling ball or the like. The present invention also realistically displays collisions with balls or the like and bumpers or other obstacles.

BRIEF DESCRIPTION OF THE DRAWINGS

FIG. 9*a* and 9*b* together provide a flow chart/block diagram depicting how the software decides how to display on the video monitor the object movement data received from the signal processing circuitry.

DESCRIPTION OF A PREFERRED EMBODIMENT

Figure 1:
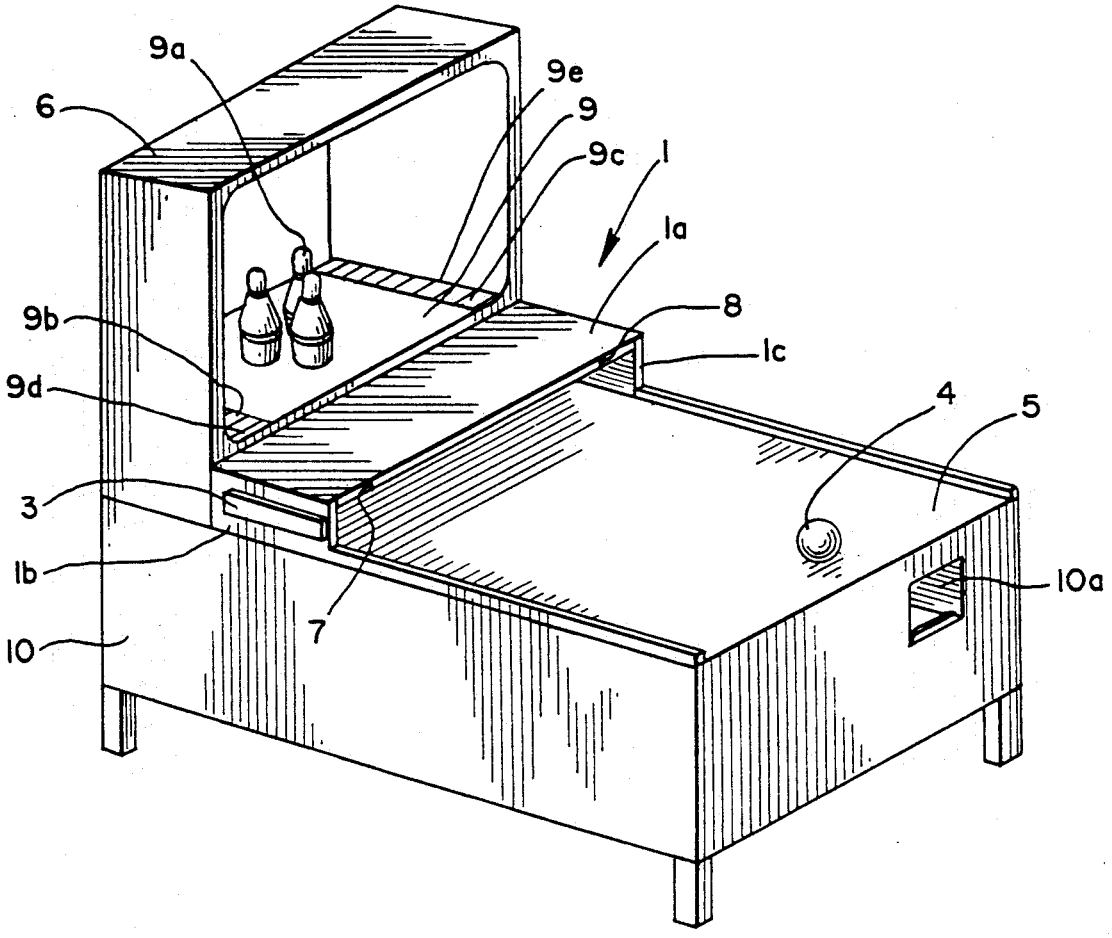
FIG. 1 is a perspective view of a game constructed in accordance with the invention, the game being illustrated in use with a bowling ball.

Referring to FIG. 1, reference number 1 designates the sensor housing. The top, left wall and right wall of the enclosure 1 are respectively designated 1*a*, 1*b* and 1*c*. In the right wall 1*c* of the sensor housing 1 are located the infrared emitters and detectors 2 and in the left wall 1*b* are located the corresponding infrared detectors and emitters 3. A bowling ball 4 is shown at the usual starting area on the bowling surface 5. Above and behind the sensor housing 1 is a video monitor 6. On the top wall of the sensor housing 1*a* are points of reference 7 and 8. Presented graphically on the video monitor 6 is a representation of a bowling alley 9, which includes an assorted number of bowling pins 9*a*, a left gutter 9*b* and right gutter 9*c* and the left edge of the bowling alley 9*d* and the right edge of the bowling alley 9*e*. Point of reference 7 aligns with the left edge of the bowling alley display 9*d* and point of reference 8 aligns with the right edge of the bowling alley 9*e*. The bowling surface 5, the sensor housing 1 and the video monitor 6 are attached to the top of the game cabinetry 10. On the bowling surface 5 between the sensor housing 1 and the base of the video monitor 6, there is an opening into the game cabinetry 10 . After a bowling ball 4 has rolled through the sensor housing 1 it falls into the opening onto a chute that is angled from back to front. At the end of the game cabinetry 10 farthest from the video monitor 6 is an opening 10*a* where the chute ends and the bowling ball 4 returns.

Figure 2:
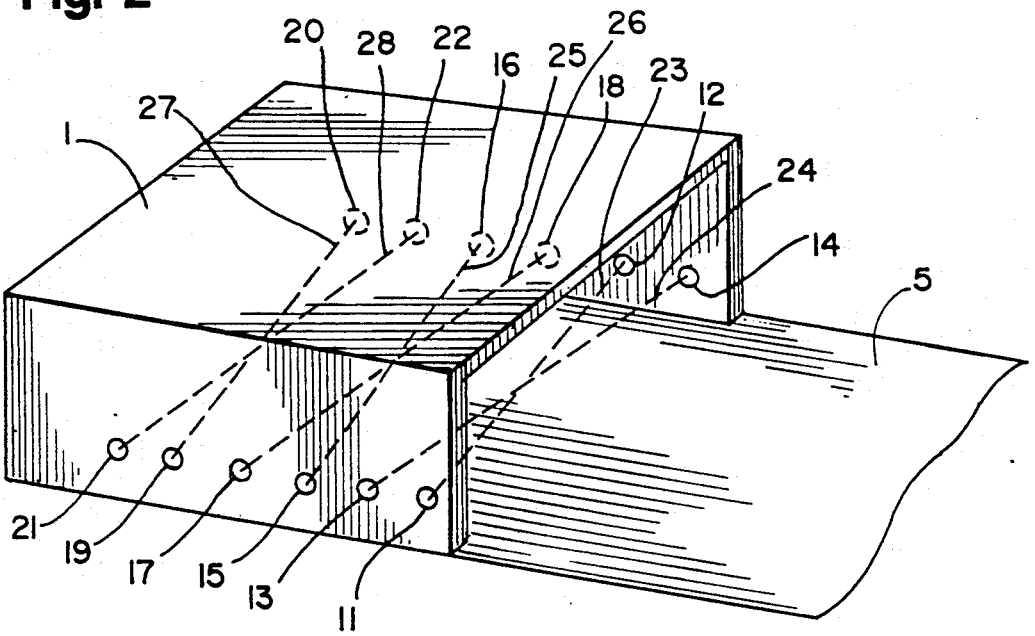
FIG. 2 is an enlarged perspective view of the sensor enclosure portion of FIG. 1 containing the infrared sensor positioning along with an illustration of the associated optical beams.
Figure 3:
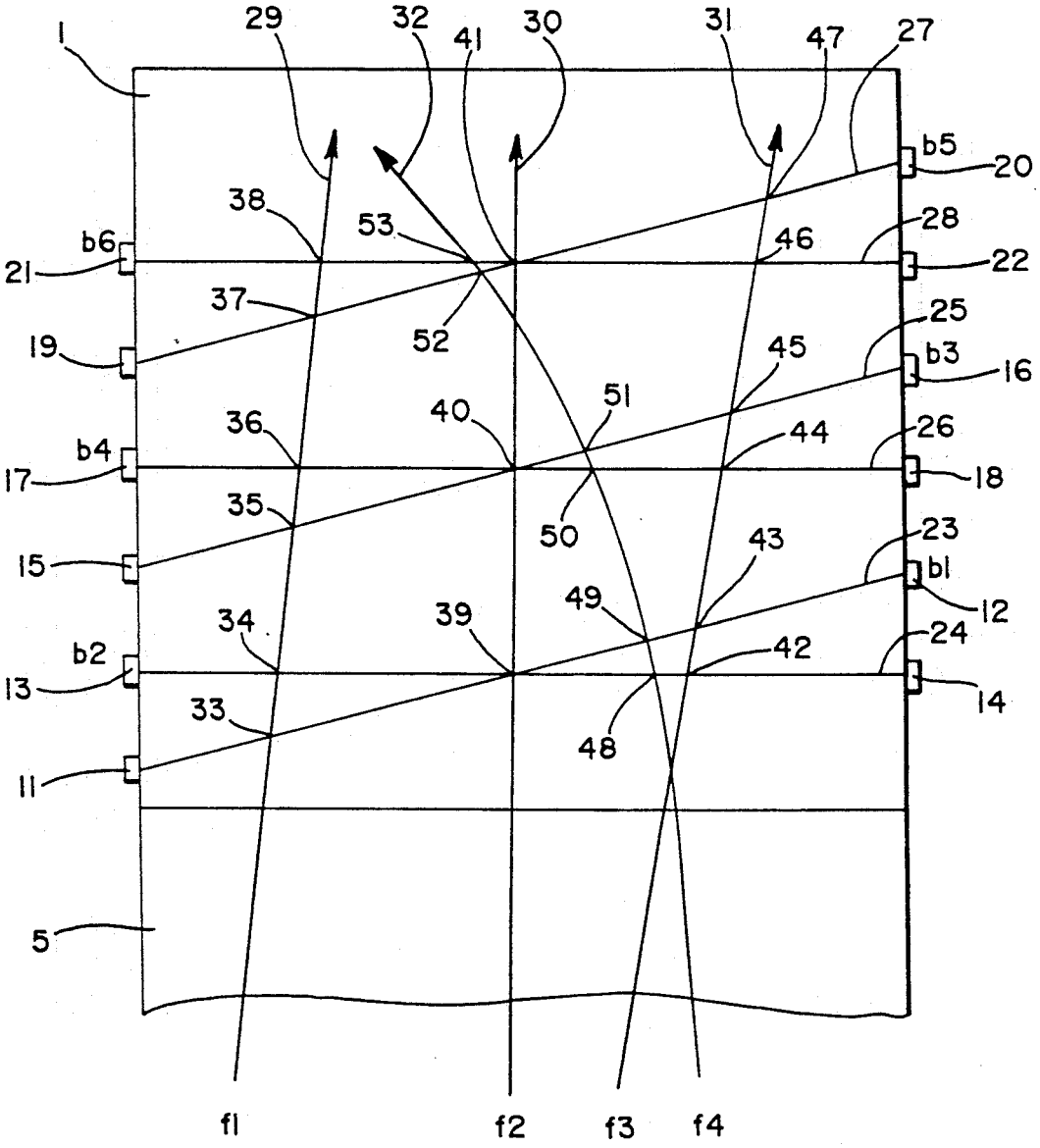
FIG. 3 is an overhead view of four typical paths of a bowling ball inside the sensor housing and how these paths intersect the sensor beams.

FIGS. 2 and 3 show the positioning of the optical sensors within the sensor housing 1. The sensors are all positioned above the bowling surface 5 by ½ the diameter of the bowling ball 4. Beam 24 comprises the light traveling from the infrared emitter 14 across to infrared detector 13. Beam 26 comprises the light traveling from the infrared emitter 18 across to infrared detector 17. Beam 28 comprises the light traveling from the infrared emitter 22 across to infrared detector 21. As the illustration shows, beam 24, beam 26 and beam 28 are parallel to one another. Beam 23 comprises the light traveling from the infrared emitter 11 across to infrared detector 12. Beam 23 bisects beam 24 at its mid-point and extends angularly with respect thereto. Beam 25 comprises the light traveling from the infrared emitter 15 across to infrared detector 16. Beam 25 bisects beam 26 at its midpoint and extends angularly with respect thereto. Beam 27 comprises the light traveling from the infrared emitter 19 across to infrared detector 20. Beam 27 bisects beam 28 at its mid-point and extends angularly with respect thereto. By positioning only emitters next to detectors lessens any possible interference from other beams.

The object path or trajectory is determined in three steps using multiple parallel reference beams and corresponding intersecting beams at acute angles. First it is determined whether the reference line is broken to the right or left of center. Then the point of actual intersection of the reference is determined by measuring deviation from the center. Finally the points of intersection of the respective reference lines are compared to define a line of movement for the ball. In addition, speed and surface resistance can be measured.

If the bowling ball 4 has broken the light of beam 23 before it has broken the light of beam 24 then the bowling ball 4 is traveling left of the mid-point of beam 24. If the bowling ball 4 has broken the light of beam 24 before it has broken the light of beam 23 then the bowling ball 4 is traveling right of the mid-point of beam 24. If the bowling ball 4 has broken the light of beam 23 and beam 24 at precisely the same time, then the bowling ball 4 is traveling on the mid-point of beam 24. By utilizing the ratio of the time the bowling ball 4 takes to travel from beam 23 to beam 26 and the time the bowling ball 4 takes to travel between beam 24 and beam 26 the invention can ascertain the amount of distance that the bowling ball 4 has deviated from the mid-point of beam 24.

If the bowling ball 4 has broken the light of beam 25 before it has broken the light of beam 26 then the bowling ball 4 is traveling left of the mid-point of beam 26. If the bowling ball 4 has broken beam 26 before it has broken beam 25 then the bowling ball 4 is traveling right of the mid-point of beam 26. If the bowling ball 4 has broken the light of beam 25 and beam 26 at precisely the same time, then the bowling ball 4 is traveling on the mid-point of beam 26. By utilizing the ratio of the time the bowling ball 4 takes to travel from beam 24 to beam 25 and the time the bowling ball 4 takes to travel between beam 24 and beam 26 the invention can ascertain the amount of distance that the bowling ball 4 has deviated from the mid-point of beam 26.

If the bowling ball 4 has broken the light of beam 27 before it has broken the light of beam 28 then the bowling ball 4 is traveling left of the mid-point of beam 28. If the bowling ball 4 has broken the light of beam 28 before it has broken the light of beam 27 then the bowling ball 4 is traveling right of the mid-point of beam 28. If the bowling ball 4 has broken the light of beam 27 and beam 28 at precisely the same time, then the bowling ball 4 is traveling on the mid-point of beam 28. By utilizing the ratio of the time the bowling ball 4 takes to travel from beam 26 to beam 27 and the time the bowling ball 4 takes to travel between beam 26 and beam 28 the invention can ascertain the amount of distance that the bowling ball 4 has deviated from the mid-point of beam 28.

Having determined the points of intersection of the beams 24, 26 and 28, the path of movement is defined. By utilizing pairs of infrared emitters and detectors the movement of a bowling ball 4 that is rolled by a bowler can be detected without any contact between ball and sensor and without the use of any foreign substance.

By ascertaining the time it takes the bowling ball 4 to travel between the parallel beams 24 and 26, or the parallel beams 26 and 28, and knowing the angle of the path relative to those beams, the invention translates this time into the speed of the moving bowling ball 4. By comparing the time it takes the bowling ball 4 to travel between the parallel beams 24 and 26 to the time it takes the bowling ball 4 to travel between the parallel beams 26 and 28, the invention can ascertain the rate at which the bowling ball 4 is slowing down, which is a measure of surface friction or resistance. The amount of distance that the bowling ball 4 has deviated from the mid-point of beam 28, which is the parallel beam farthest from the starting point in the preferred embodiment, is used as the initial columnar position of the graphic presentation of the bowling ball on the video monitor 6.

In the preferred embodiment, by comparing the amount of distance that the bowling ball 4 has deviated from the mid-point of beam 24 with the amount of distance that the bowling ball 4 has deviated from the mid-point of beam 26 and with the amount of distance that the bowling ball 4 has deviated from the mid-point of beam 28, the invention can determine the angle and curvature of the bowling ball 4 movement.

In a variation of the invention, one in which the moving projectile would be expected to move in a straight path, beams 23 and 24 would not be necessary. The sensor housing could then be smaller. A pool game using a rolling cue ball or a bowling game using a sliding disc could fall under this variation.

FIG. 3 is an overhead view showing the outline of the sensor housing 1. It illustrates how a ball following a path f1 29 starting left of center and angling toward the right and a ball hit straight on a path f2 30 and a ball's path f3 31 that is hit right of center and is angling toward the right and a ball's path f4 32 that is starting right of center and is curving left over center each intersect the six beams, 23, 24, 25, 26, 27 and 28. Path f1 29 intersects beam 23 at point 33 prior to intersecting beam 24 at point 34, which indicates that it is on a path left of center. It then intersects beam 25 at point 35 prior to intersecting beam 26 at point 36, which indicates that it is continuing on a path left of center. It then intersects beam 27 at point 37 prior to intersecting beam 28 at point 38, which indicates that it is continuing on a path left of center. Path f2 30 intersects beam 23 and 24 at the same point 39 and intersects beams 25 and 26 at the same point 40 and intersects beams 27 and 28 at the same point 41, which indicates that it is a straight path down the center. Path f3 31 intersects beam 24 at point 42 prior to intersecting beam 23 at point 43, which indicates that it is on a path right of center. It then intersects beam 26 at point 44 prior to intersecting beam 25 at point 45, which indicates that it is continuing on a path right of center. It then intersects beam 28 at point 46 prior to intersecting beam 27 at point 47, which indicates that it is continuing on a path right of center. Path f4 32 intersects beam 24 at point 48 prior to intersecting beam 23 at point 49, which indicates that it is on a path right of center. It then intersects beam 26 at point 50 prior to intersecting beam 25 at point 51, which indicates that it is continuing on a path right of center. It then intersects beam 27 at point 52 prior to intersecting beam 28 at point 53, which indicates that it has crossed over on a path left of center.

Figure 4:
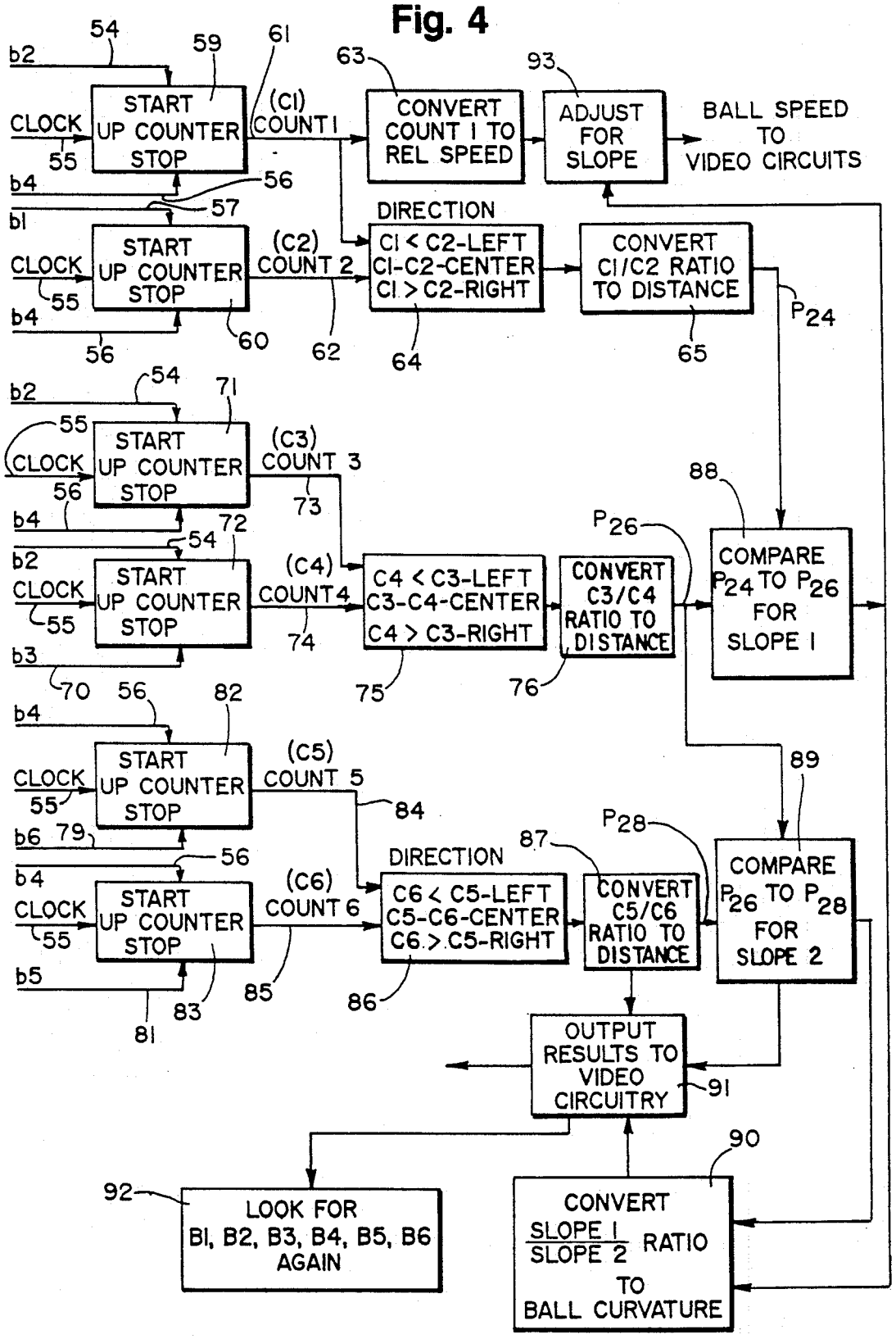
FIG. 4 is a flow chart/block diagram depicting how the sensor output gets converted to distance slope, and curvature information and output to the video control circuitry.

FIG. 4 is a flow chart illustrating how the sensor information from infrared detectors 12, 13, 16, 17, 20 and 21 (signals b1 57, b2 54, b3 70, b4 56, b5 81 and b6 79 respectively) is converted into a final output. A clock input 55 increments six up counters 59, 60, 71, 72, 82 and 83 to create count C1 61, C2 62, C3 73, C4 74, C5 84 and C6 85 respectively. The C1 Count 61, is the result of detector signal b2 54 starting the up counter 59 and b4 56 stopping same. C1 61 is then converted to a number at 63 relative to the speed of the bowling ball 4. The number 63 is adjusted for the slope of the object path 88 to obtain object speed at 93. The number 63 is then output to the video control circuitry 91. The C2 Count 62 is the result of b1 57 starting the up counter 60 and b4 56 stopping same. C2 62 is then compared to C1 61 to arrive at the position relating to center (direction), as indicated at 64. The ratio of C1 61 over C2 62 is then converted to a direction distance number 65 relative to the distance of the ball's path left or right of center. The C3 Count 73, is the result of detector signal b2 54 starting the up counter 71 and b4 56 stopping same. The C4 Count 74 is the result of b2 54 starting the up counter 72 and b3 70 stopping same. C4 74 is then compared to C3 73 to arrive at the position relating to center (direction), as indicated at 75. The ratio of C3 73 over C4 74 is then converted to a direction distance number 76 relative to the distance of the ball's path left or right of center. The direction distance number 65 is then compared with the direction distance number 76 at 88 to come up with the slope of the ball path between beam 23, 24 and beam 26, 25. The C5 Count 84, is the result of detector signal b4 56 starting the up counter 82 and b6 79 stopping same. The C6 Count 85 is the result of b4 56 starting the up counter 83 and b5 81 stopping same. C6 85 is then compared to C5 84 to arrive at the position relating to center (direction), as indicated at 86. The ratio of C5 84 over C6 85 is then converted to a direction distance number 87 relative to the distance of the ball's path left or right of center. The direction distance number 76 is then output to the video control circuitry 91. The direction distance number 76 is then compared with the direction distance number 87 at 89 to come up with the slope of the ball path between beams 26, 25 and beams 28, 27. The slope 89 is then output to the video control circuitry 91. The slope 88 is then compared with the slope 89 to come up with a number representing the ball path curvature 90. The ball path curvature number 90 is then output to the video control circuitry 91. After the video control circuity receives all the output 91, the activity then reverts back to the six up counters 59, 60, 71, 72, 82 and 83.

Figure 5:
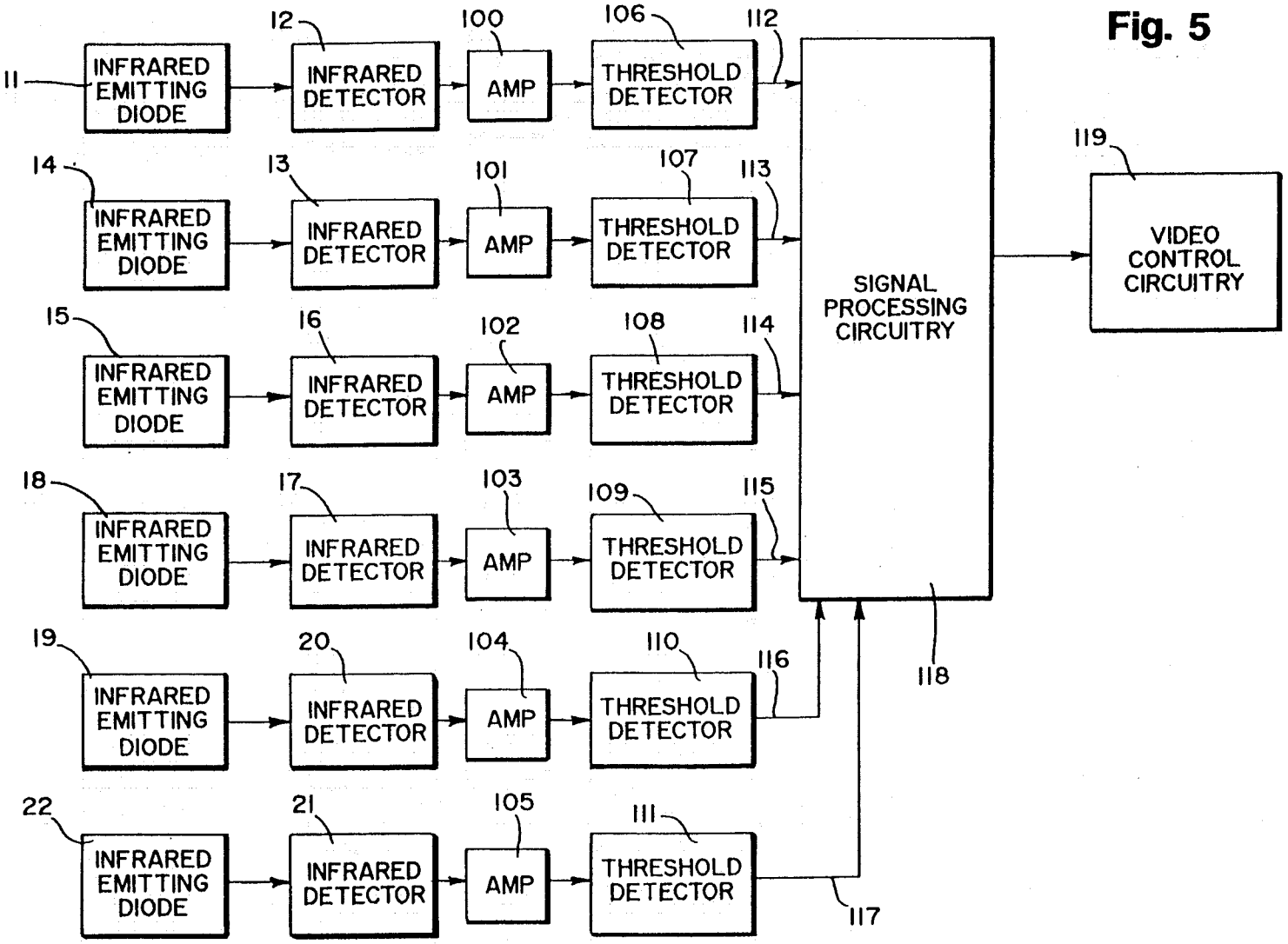
FIG. 5 is a block diagram of the circuitry of the game shown in FIG. 1.

FIG. 5 is a block diagram of the circuitry of the invention. The principal element of the circuit is a signal processing circuit 118, which is preferably a microprocessor. Inputs 112, 113, 114, 115, 116 and 117 to the processor 118 come from each of the beam detection channels described below.

Turning first to the beam detection channels, the infrared emitting diode 11 beams radiation in the direction of infrared detector 12. As long as the radiation is not interrupted, the input 112 to the signal processing circuitry 118 is set at 0. If the radiation is interrupted by a moving bowling ball 4, the infrared detector 12 output falls towards zero volts. This change of voltage is inverted and amplified in amplifier 100. The altered voltage is then compared in a threshold detector 106 with a threshold voltage set at a trigger point and, if the altered voltage is greater than the trigger point voltage, then an input 112 of 5 volts is delivered to the signal processing circuitry 118. Similarly, the infrared emitting diode 14 beams radiation in the direction of infrared detector 13. As long as the radiation is not interrupted, the input 113 to the signal processing circuitry 118 is set at 0. If the radiation is interrupted by a moving bowling ball 4, the infrared detector 13 output falls towards zero volts. This change of voltage is inverted and amplified in amplifier 101. The altered voltage is then compared in a threshold detector 107 with a threshold voltage set at a trigger point and, if the altered voltage is greater than the trigger point voltage, then an input 113 of 5 volts is delivered to the signal processing circuitry 118. Similarly, the infrared emitting diode 15 beams radiation in the direction of infrared detector 16. As long as the radiation is not interrupted, the input 114 to the signal processing circuitry 118 is set at 0. If the radiation is interrupted by a moving bowling ball 4, the infrared detector 16 output falls towards zero volts. This change of voltage is inverted and amplified in amplifier 102. The altered voltage is then compared in a threshold detector 108 with a threshold voltage set at a trigger point and, if the altered voltage is greater than the trigger point voltage, then an input 114 of 5 volts is delivered to the signal processing circuitry 118. Similarly, the infrared emitting diode 18 beams radiation in the direction of infrared detector 17. As long as the radiation is not interrupted, the input 115 to the signal processing circuitry 118 is set at 0. If the radiation is interrupted by a moving bowling ball 4, the infrared detector 17 output falls towards zero volts. This change of voltage is inverted and amplified in amplifier 103. The altered voltage is then compared in a threshold detector 109 with a threshold voltage set at a trigger point and, if the altered voltage is greater than the trigger point voltage, then an input 115 of 5 volts is delivered to the signal processing circuitry 118. Similarly, the infrared emitting diode 19 beams radiation in the direction of infrared detector 20. As long as the radiation is not interrupted, the input 116 to the signal processing circuitry 118 is set at 0. If the radiation is interrupted by a moving bowling ball 4, the infrared detector 20 output falls towards zero volts. This change of voltage is inverted and amplified in amplifier 104. The altered voltage is then compared in a threshold detector 110 with a threshold voltage set at a trigger point and, if the altered voltage is greater than the trigger point voltage, then an input 116 of 5 volts is delivered to the signal processing circuitry 118. Similarly, the infrared emitting diode 22 beams radiation in the direction of infrared detector 21. As long as the radiation is not interrupted, the input 117 to the signal processing circuitry 118 is set at 0. If the radiation is interrupted by a moving bowling ball 4, the infrared detector 21 output falls towards zero volts. This change of voltage is inverted and amplified in amplifier 105. The altered voltage is then compared in a threshold detector 111 with a threshold voltage set at a trigger point and, if the altered voltage is greater than the trigger point voltage, then an input 117 of 5 volts is delivered to the signal processing circuitry 118.

The signal processing circuitry 118 in a variation of the invention, one in which the moving projectile would be expected to move in a straight path, one in which beams 23 and 24 would not be necessary, is an Intel Microprocessor chip, D8749, containing the following hexadecimal machine code (Copyright 1990, Daniel J. Dooley):

| | | | | | | | | | | | | | | | |
|---|---|---|---|---|---|---|---|---|---|---|---|---|---|---|---|
| 9A | FF | 99 | FC | C5 | 27 | B8 | 7F | A0 | E8 | 08 | 62 | 16 | 0E | 23 | FF |
| 02 | 00 | 14 | 25 | F9 | C6 | 1B | 54 | 8D | 04 | 12 | 54 | B6 | 14 | A3 | 54 |
| 1E | 54 | 5B | 04 | 12 | C5 | 27 | 99 | FC | B8 | 07 | A0 | E8 | 2B | 09 | 52 |
| 3C | 86 | 2E | 14 | 94 | 09 | 52 | 4A | 16 | A0 | 04 | 35 | 14 | 94 | 16 | A0 |
| 86 | 3E | 14 | 8B | B8 | 52 | B0 | FF | B8 | 50 | FB | A0 | 18 | FC | A0 | 09 |
| 72 | 60 | 92 | 66 | 16 | A0 | 04 | 57 | BD | FF | B9 | 08 | 14 | 8B | 09 | 59 |
| 16 | A0 | C6 | 6C | 99 | FC | 0A | B8 | 59 | A0 | 42 | C8 | A0 | B8 | 56 | FD |
| A0 | C8 | FC | A0 | C8 | FB | A0 | 42 | 03 | EC | E6 | A0 | 83 | 99 | FC | 0A |
| AC | 42 | AB | 89 | 02 | 83 | 45 | 89 | 01 | 99 | FE | 89 | 02 | 27 | 62 | 16 |
| 9F | 83 | B9 | FF | 83 | 24 | 61 | B8 | 07 | F0 | AF | C8 | F0 | AE | BA | 24 |
| BB | 9F | B9 | 00 | B8 | 00 | FF | 37 | 03 | 01 | AF | FE | 37 | 13 | 00 | AE |
| FB | 6F | AB | FA | 7E | AA | E6 | DA | 14 | D3 | 97 | FB | F7 | AB | FA | F7 |
| AA | EC | BE | 04 | E8 | F9 | F7 | A9 | F8 | F7 | A8 | 83 | 14 | D3 | FB | C5 |
| 6F | D5 | AB | FA | C5 | 7E | D5 | AA | 04 | C8 | F9 | AD | F8 | AC | 27 | AA |
| AB | FD | 03 | 00 | AB | FC | 13 | F6 | AA | BC | 04 | 00 | 00 | 00 | 00 | 00 |
| 00 | 00 | 97 | FA | 67 | AA | FB | 67 | AB | EC | 00 | FB | 03 | 26 | AB | FA |
| 13 | 01 | AA | F8 | AE | F9 | AF | 27 | AD | AC | B8 | 30 | A0 | 18 | A0 | 18 |
| A0 | 18 | A0 | B9 | 0C | 34 | 26 | 83 | 27 | FA | 67 | AA | FB | 67 | AB | 00 |
| 00 | 00 | F6 | 4E | 97 | FF | F7 | AF | FE | F7 | AE | FD | F7 | AD | FC | F7 |
| AC | E9 | 4C | B8 | 30 | B9 | 40 | F0 | A1 | 18 | 19 | F0 | A1 | 83 | 24 | 26 |
| B8 | 33 | F0 | 6F | A0 | C8 | F0 | 7E | A0 | C8 | F0 | 7D | A0 | C8 | F0 | 7C |
| A0 | 24 | 32 | FE | 03 | 6E | E6 | 76 | 97 | FE | 67 | AE | FF | 67 | AF | D5 |
| B8 | 2F | B0 | FF | BC | 0F | 04 | A5 | D5 | B8 | 2F | B0 | 00 | BC | 10 | 04 |
| A5 | B8 | 2F | F0 | C5 | C6 | 8C | 97 | FF | F7 | AF | FE | F7 | AE | FD | B8 |
| 1A | C6 | A2 | FB | A0 | 18 | FC | A0 | 18 | 18 | 18 | FE | A0 | 18 | FF | A0 |
| B8 | 04 | 24 | B1 | FE | A0 | 18 | FF | A0 | 18 | 18 | 18 | FB | A0 | 18 | FC |
| A0 | B8 | 07 | D5 | 27 | A8 | A9 | FB | 37 | 03 | 01 | AB | FA | 37 | 13 | 00 |
| AA | BC | 09 | FF | 6B | AF | FE | 7A | AE | E6 | D6 | 14 | D3 | 97 | FF | F7 |
| AF | FE | F7 | AE | EC | C1 | 24 | E6 | 14 | D3 | FF | C5 | 60 | C8 | D5 | AF |
| FE | C5 | 70 | 18 | D5 | AE | 24 | CB | 00 | F9 | 03 | 39 | A9 | BD | 18 | BE |
| 00 | BA | 00 | BB | 00 | BC | 00 | 97 | F9 | F7 | A9 | FE | F7 | AE | 03 | C7 |
| 00 | E6 | 02 | AE | FC | F7 | AC | FB | F7 | AB | FA | F7 | AA | ED | 1C | B8 |
| 02 | 97 | FA | 67 | AA | FB | 67 | AB | FC | 67 | AC | E8 | 0F | 83 | 24 | F5 |
| C5 | B8 | 56 | F0 | 37 | AD | 34 | 7F | B8 | 56 | F0 | C6 | 31 | FB | 37 | 97 |
| 67 | 44 | 36 | FB | 97 | 67 | 43 | 80 | B8 | 60 | A0 | C5 | B8 | 5C | F0 | AC |
| C8 | F0 | AB | B8 | 52 | F0 | AD | 34 | 7F | B8 | 52 | F0 | C6 | 52 | FB | 37 |
| 97 | 67 | 44 | 57 | FB | 97 | 67 | 43 | 80 | B8 | 61 | A0 | 83 | D5 | B8 | 60 |
| F0 | 54 | 6F | 18 | F0 | 54 | 6F | B8 | 40 | F0 | 54 | 6F | 18 | F0 | 54 | 6F |
| 83 | B9 | 08 | 97 | F7 | F6 | 7B | 98 | FC | 54 | 86 | 44 | 7F | 98 | FD | 54 |
| 86 | 88 | FF | 54 | 86 | E9 | 71 | 83 | BB | 0A | EB | 88 | 83 | 00 | 00 | 27 |
| 54 | 6F | 27 | 54 | 6F | 27 | 54 | 6F | 27 | 54 | 6F | 83 | F0 | AF | C8 | F0 |
| AE | F1 | AC | C9 | F1 | AB | 83 | B8 | 5C | FF | A0 | C8 | FE | A0 | 18 | 83 |
| F0 | 6A | A0 | C8 | F0 | 79 | A0 | 83 | B8 | 56 | F0 | C6 | C2 | C8 | B9 | 59 |
| 54 | 9A | 44 | C8 | B8 | 59 | B9 | 55 | 54 | 9A | B9 | 51 | F1 | 37 | 03 | 01 |
| AA | C9 | F1 | 37 | 13 | 00 | A9 | B8 | 52 | F0 | C6 | DF | 54 | A5 | 54 | AE |
| 83 | 54 | A5 | B8 | 07 | 54 | AE | B8 | 04 | 54 | AE | 83 | | | | |

The foregoing code is used by the microprocessor to assimilate all the inputs and convert them to an output form (in the general manner shown and described above in connection with FIG. 4), which is sent to video control circuitry 119 (which may include a microprocessor or be an entire computer system).

A variation of the invention is a device that uses a similar sensor housing and sensor arrangement. The output from the sensors however, are sent via cable to an input port ( a joy stick port, for instance) of a personal computer of a video game system (such as ones built by Nintendo or Sega). The personal computer or video game system has running software that makes all the necessary computations and calculations necessary to come up with distance and direction. For personal computers or video game systems that lack an adequate means to time the sensor information in a precise and accurate fashion, electronics would be available on the invention that would convert the sensor information to distance and direction data and in turn would convey this data to the personal computer or video game system via a serial link.

Another variation of the invention would be an arcade-style machine that would allow a person to play the game after paying money. In essence the arcade-like machine would incorporate the same positioning and use of the sensors as the other variations of the invention did.

Another variation of the invention would be the use of pressure-sensitive strips, momentary contact-like switches or upwardly pointing light emitters/detectors, laid across the width of the sensor housing in much the same pattern as the optical beams but positioned on top of or imbedded into the surface. When the propelled ball or sliding disc rolls across the strips, switches or emitters/detectors, information corresponding to the optical sensors' output used in the preferred embodiment of the invention would be attained.

Figure 6:
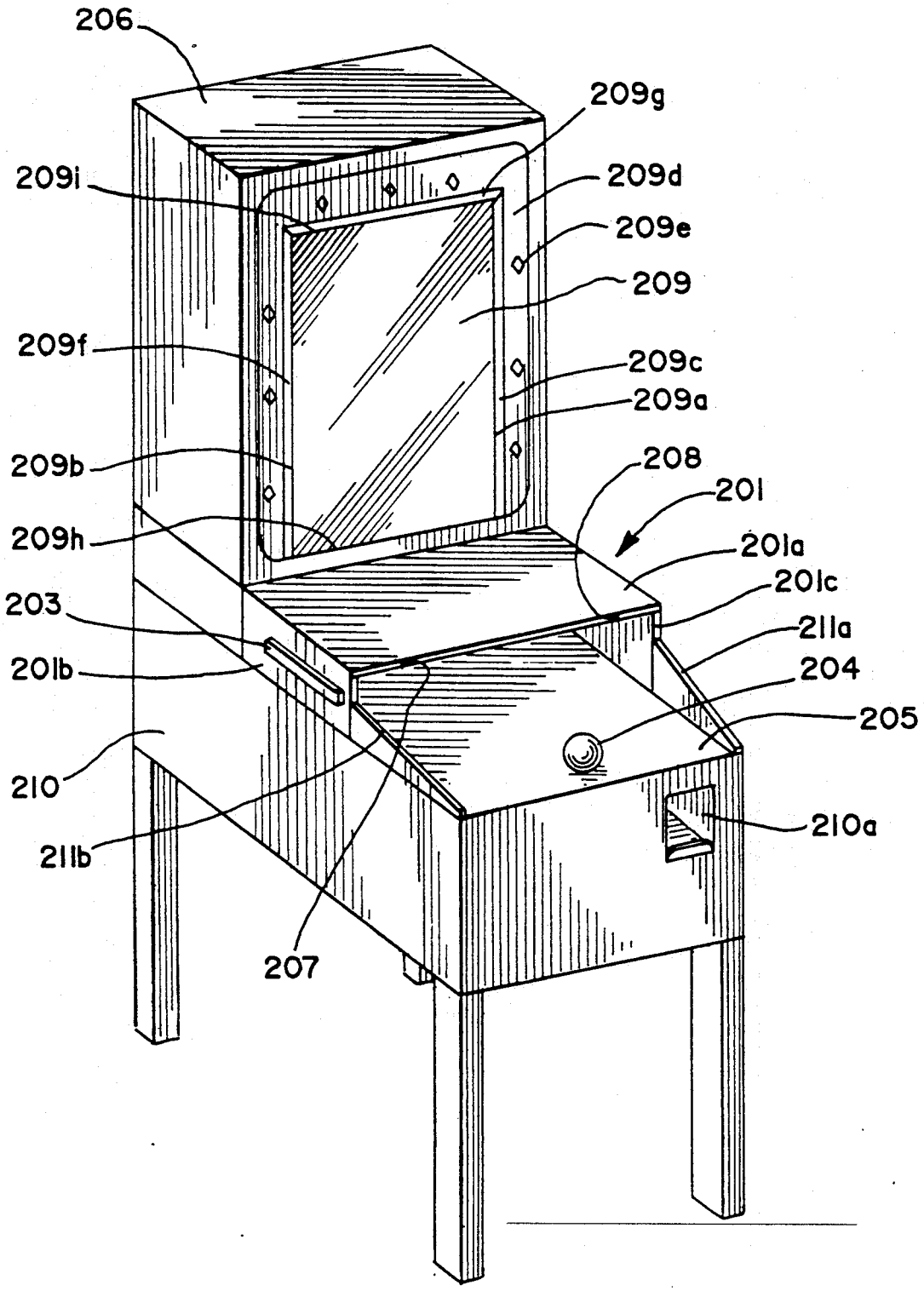
FIG. 6 is a perspective view of a game constructed in accordance with the invention, the game being illustrated in use with a pool ball.

Referring to FIG. 6, reference number 201 designates the sensor housing. The top, left wall and right wall of the enclosure 201 are respectively designated 201*a*, 201*b* and 201*c*. In the right wall 201*c* of the sensor housing 201 are located the infrared emitters and detectors (not shown in FIG. 6) and in the left wall 201*b* are located the corresponding infrared detectors and emitters located in a housing. A pool cue ball 204 is shown at the usual starting area on the pool surface 205, typically green felt. Above and behind the sensor housing 201 is a video monitor 206. On the top wall of the sensor housing 201*a* are point of references 207 and 208. Presented graphically on the video monitor 206 is a representation of a pool table 209, which includes a left bumper (or cushion) 209*f*, a top bumper 209*g* and a right bumper 209*c*.

Outside of the bumpers, in the portion of the pool table 209*d* that is an extension of the bumpers 209*f*, 209*g* and 209*c* and is typically made of wood or plastic are diamond shaped aiming points 209*e*. The area bounded by the right edge of the left bumper 209*f* 209*b*, the lower edge of the top bumper 209*g* 209*i*, the left edge of the right bumper 209*c* 209*a* and the upper edge of the lower bumper ( which is not displayed on the video monitor ) 209*h* is displayed in the same color as the pool surface 205 and is typically green. This is the area in which the cue ball drawings are displayed. Point of reference 207 aligns with the right edge of the left bumper 209*b* and point of reference 208 aligns with the left edge of the right bumper 209*a*.

The pool surface 205, the sensor housing 201 and the video monitor 206 are attached to the top of the game cabinetry 210. On the pool surface 205 between the sensor housing 201 and the base of the video monitor 206, there is an opening into the game cabinetry 210. After a cue ball 204 has rolled through the sensor housing 201 it falls into the opening onto a chute that is angled from back to front. At the end of the game cabinetry 210 farthest from the video monitor 206 is an opening 210*a* where the chute ends and the cue ball 204 returns to.

There is a left ball guard 211*b* and a right ball guard 211*a* on the sides of the pool surface 205. The left ball guard 211*b* is located between the left side of the sensor housing 201*b* and the left front edge of the game cabinetry 210. The right ball guard 211*a* is located between the right side of the sensor housing 201*c* and the right front edge of the game cabinetry 210. These guards 211*a* and 211*b* are to prevent any cue ball miss-hits dropping the cue ball 204 onto the ground.

Typically, a video monitor is positioned so that the width is larger than the height. For the typical pool game, however, the video monitor 206 is rotated 90 degrees so the height is larger than the width. The video monitor 206 is usually tilted back to aid the pool player with depth perception.

Figure 7:
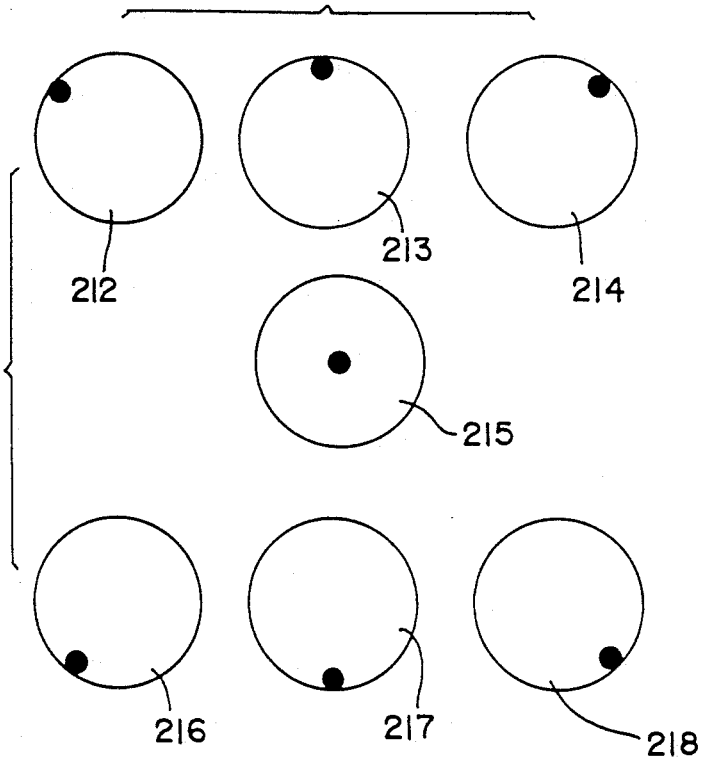
FIG. 7 is an enlarged graphical representation showing all the cue ball orientations needed to display angular and straight path movement of a cue ball on the video monitor.

FIG. 7 is an enlarged graphical representation of all the cue ball orientations needed to display angular and straight path movement of a cue ball on the video monitor. All of these orientations have a red circle of similar size positioned at a different point within the cue ball.

These orientations relate to the Motorola 68000 Assembly Source Code listing that is included in this application. The source code listing of these orientations was developed on a Atari ST computer where the display is wider than it is high. Thus the representation of the top of the pool table on the Atari monitor is at the left. The labeling used in the source code listings follows this convention.

The cue ball drawing 212 has the red mark located in the upper left section of the cue ball ( as displayed on the video monitor 206 ). The source code listing of it is labeled "Red mark Lower Left" and also uses labels that have extensions of "_11".

The cue ball drawing 213 has the red mark located in the upper middle section of the cue ball ( as displayed on the video monitor 206 ). The source code listing of it is labeled "Red mark High Middle" and also uses labels that have extensions of "_hm".

The cue ball drawing 214 has the red mark located in the upper right section of the cue ball ( as displayed on the video monitor 206 ). The source code listing of it is labeled "Red mark High Left" and also uses labels that have extensions of "_hl".

The cue ball drawing 215 has the red mark located in the middle section of the cue ball ( as displayed on the video monitor 206 ). The source code listing of it is labeled "YELLOW CUE BALL W/ MIDDLE RED SPOT" and also uses labels that have extensions of "_mm".

The cue ball drawing 216 has the red mark located in the lower left section of the cue ball ( as displayed on the video monitor 206 ). The source code listing of it is labeled "Red mark Lower Right" and also uses labels that have extensions of "_lr".

The cue ball drawing 217 has the red mark located in the lower middle section of the cue ball ( as displayed on the video monitor 206 ). The source code listing of it is labeled "Red mark Lower Middle" and also uses labels that have extensions of "_lm".

The cue ball drawing 218 has the red mark located in the lower right section of the cue ball ( as displayed on the video monitor 206 ). The source code listing of it is labeled "Red mark High Right" and also uses labels that have extensions of "_hr".

Figure 8:
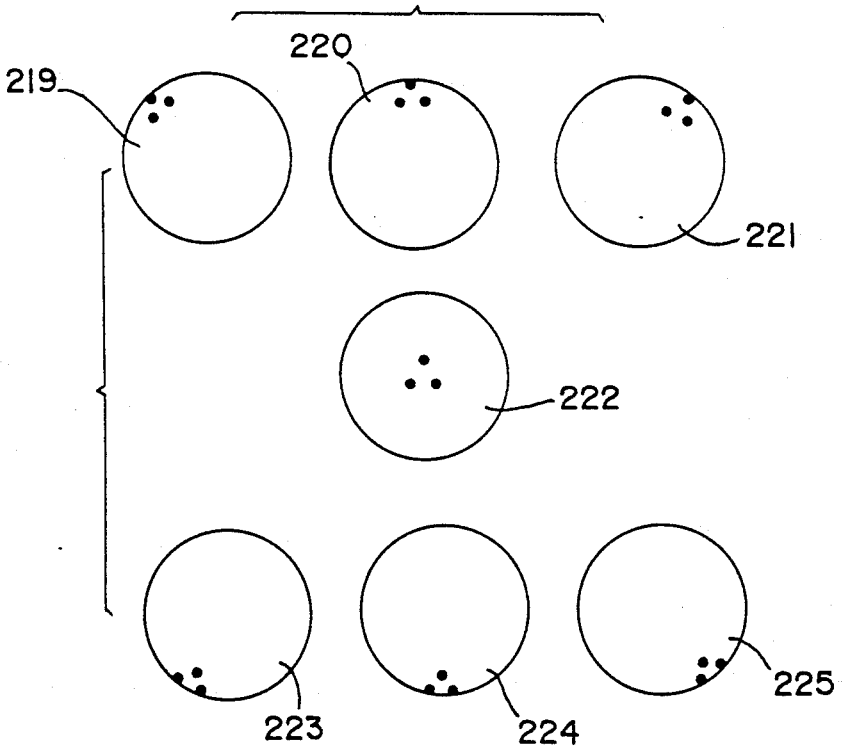
FIG. 8 is an enlarged graphical representation showing all the bowling ball orientations needed to display angular and straight path movement of a bowling ball on the video monitor.

FIG. 8 illustrates the same ball orientations shown in FIG. 7 but in this case the ball is a bowling ball and the marks are finger holes typically found in a bowling ball. The orientations at 219–225 correspond to the similar orientations at 212–218 in FIG. 7.

Figure 9A:
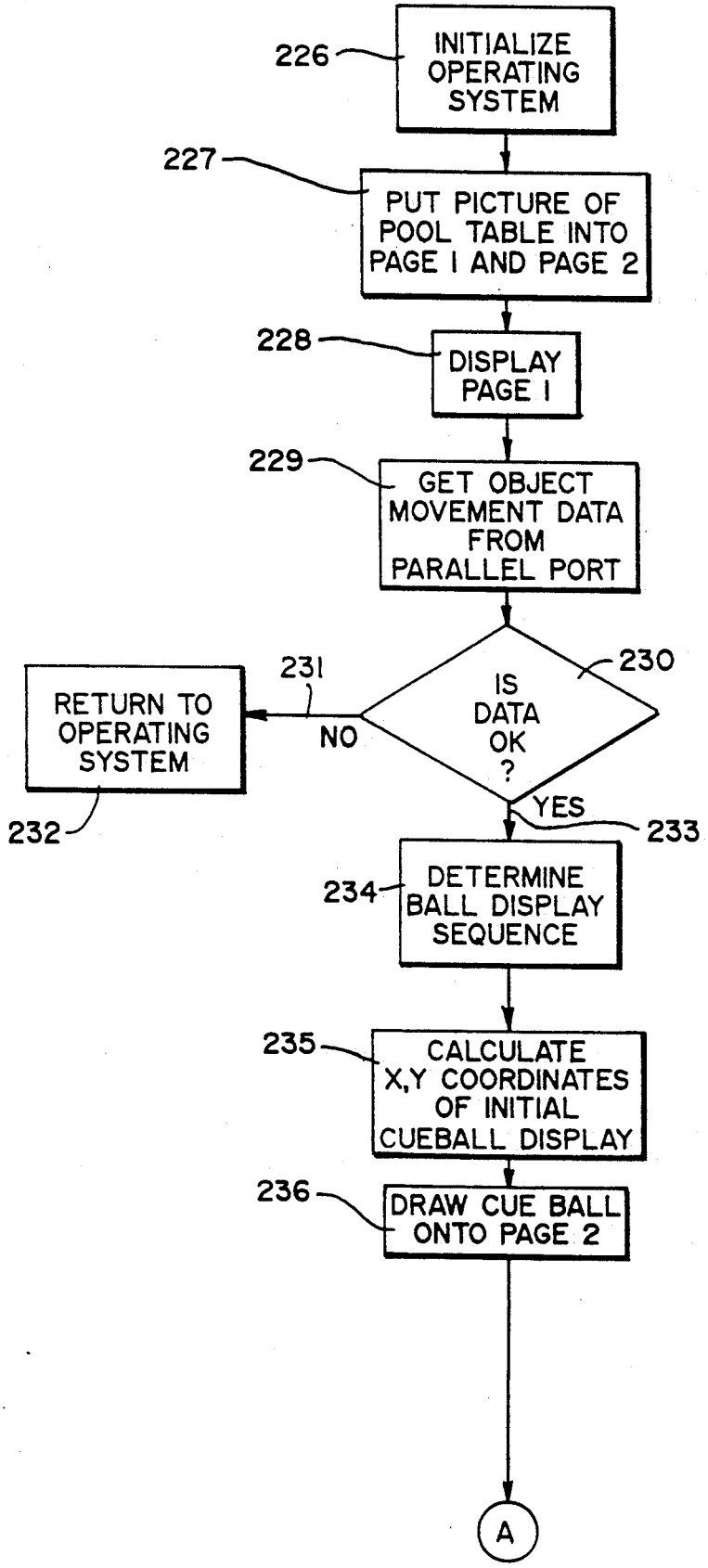

FIGS. 9*a* and 9*b* together provide a flow chart/block diagram depicting the software decision process used to display on the video monitor the object movement data received from the signal processing circuitry. This program takes the cue ball movement data and translates it into a visual moving cue ball that has the actions of a struck cue ball, rotating while moving on a pocketless pool table. Any bouncing off of bumpers will be displayed and the cue ball's movement will gradually slow down until it rests at one spot on the table.

As shown in FIG. 9*a*, the operating system of the computer used in the video control circuitry is initialized 226 so that it is in the graphics mode with 2 separate memory locations set up as display pages. A digital representation of the pool table is loaded into each of the display page memory locations 227. The digital representation may be transferred from a disk, a tape or a ROM or RAM location. The pool table picture will serve as background to the viewer of the video display. The inner edges of it's bumpers will also serve as the visual boundaries for the moving pool ball on the display 206.

Display page 1 will be displayed 228. Initially, it will be a display of just the pool table. The player strikes the cue ball 204 with a pool cue and it travels through the sensor housing 201. The inputs from the sensors are converted by the signal processing circuitry 118. The data relating to the cue ball movement is transferred via a parallel port to the video control circuitry 119 and is stored by the program 229. The transferred data is analyzed 230.

If the data is not in the proper form 231 it signifies that possibly the ball was miss-hit or the sensor system, signal processing circuitry or the parallel transfer system malfunctioned. At this point the program is aborted and control of the computer is returned to the operating system 232.

If the cue ball movement data is in the proper form 233 then the process of displaying the cue ball on the video monitor 206 will begin.

The sequence of cue ball orientations is first determined 234 by the angle of movement path. Initially all video ball movement is from bottom to top. If the angle signifies a ball movement from right to left the display sequence would follow 218, 215 and 212. This would have the red dot alternately moving from the lower right portion of the cue ball 218 to center 215 to the upper left portion of the cue ball 212. This sequence of cue ball display works in conjunction with the cue ball screen movement on the right to left angled path to give the viewer a realistic feel of a moving pool ball.

The initial cue ball display coordinates is determined 235 using the direction distance number that relates to the sensor inputs closest to the video monitor 206. The cue ball picture as determined at 234 is drawn on display page 2 236 so that it starts out at the bottom of the screen.

As shown in FIG. 9*b*, the video display circuitry is then switched to display the draw page 237 ( which was display page 2 ). At this point the previous display page turns into the current draw page 238.

There is a need for a delay so that the user's eyes can pick up the display representations. This delay is also increased periodically 239 to enhance the effect of cue ball movement slowing down over time. An actual pool ball moving on a pool table slows down and eventually stops because of surface and air friction working against it.

The delay is generated 240 by having a short software sequence of known time duration executed repeatedly for a set number of times. This delay could be generated by a number of other means which could include use of a hardware counter circuitry.

The current draw page is cleared of any previous cue ball representations by drawing a picture 241 of the same size as the cue ball but in the color of the background table surface, which is green. This green shape is drawn using the previous coordinates of the cue ball display position, as differed from the coordinates used for the cue ball display on the current display page.

The next display coordinates of the cue ball are calculated 246. The speed data of the movement path is used along with the angle of path movement, any curving data and the previous position of the cue ball display. As the display sequence continues, the magnitude of coordinate path change lessens. This enhances the visual effect of the cue ball slowing down.

The calculated display coordinates are then examined to see if they would leave the cue ball entirely on the display playing surface 247. The display playing surface is defined as the area bounded by the right edge of the left bumper 209*f* 209*b*, the lower edge of the top bumper 209*g* 209*i*, the left edge of the right bumper 209*c* 209*a* and the upper edge of the lower bumper ( which is not displayed on the video monitor ) 209*h*.

If the new coordinates are within the display playing surface 248, then the cue ball display sequence is updated to the next representation 261. The cue ball representation is then drawn at the new coordinates 262 and the software loops back to changing the video control circuitry so that the draw page is now displayed 237.

If the new coordinates are outside of the display playing surface 249, then the new coordinates need to be changed so that the cue ball is displayed next to the intersected bumper 250 at the point the projected path intersects the bumper.

It has to be determined if the projected path intersects the top bumper on line 209*i* 251. If it does 252, then the cue ball display sequence is altered so that the sequence follows an upper to lower pattern 260. An example is a straight path movement that would have as it's prior cue ball display sequence a cue ball with the red circle in it's lower center area 217, a centered red circle cue ball 215 and then a cue ball with the red circle in it's upper middle area 213.

The sequence would now change to 213, 215, 217. This change enhances the visual effect of the cue ball path changing directions. The cue ball display sequence is then updated to the next representation 261. The cue ball representation is then drawn at the new coordinates 262 and the software loops back to changing the video control circuitry so that the draw page is now displayed 237.

If the projected display path did not intersect the top bumper 253 then a determination is made concerning the intersecting of the bottom bumper 254 on the display line 209*h*.

If it does 255, then the cue ball display sequence is altered so that the sequence follows a lower to upper pattern 259. An example is a right to left path movement that would have as it's prior cue ball display sequence a cue ball with the red circle in it's upper right area 214, a centered red circle cue ball 215 and then a cue ball with the red circle in it's lower left area 216.

The sequence would now change to lower right circle placement 218, centered 215, upper left circle placement 212. This change enhances the visual effect of the cue ball path changing directions. The cue ball display sequence is then updated to the next representation 261. The cue ball representation is then drawn at the new coordinates 262 and the software loops back to changing the video control circuitry so that the draw page is now displayed 237.

If the projected path intersection was not of the top or bottom bumper then one of the side bumpers at a point on line 209*b* or 209*a* was intersected 257. The cue ball display sequence is altered so that the sequence changes from a left to right pattern to a right to left pattern or from a right to left pattern to a left to right pattern 258. An example is a right to left, downward (top of screen to bottom) path movement that would have as it's prior cue ball display sequence a cue ball with the red circle in it's upper right area 214, a centered red circle cue ball 215 and then a cue ball with the red circle in it's lower left area 216. The sequence would now change to upper left circle placement 212, centered 215, lower right circle placement 218.

The cue ball display sequence is then updated to the next representation 261. The cue ball representation is then drawn at the new coordinates 262 and the software loops back to changing the video control circuitry so that the draw page is now displayed 237.

Figure 10:
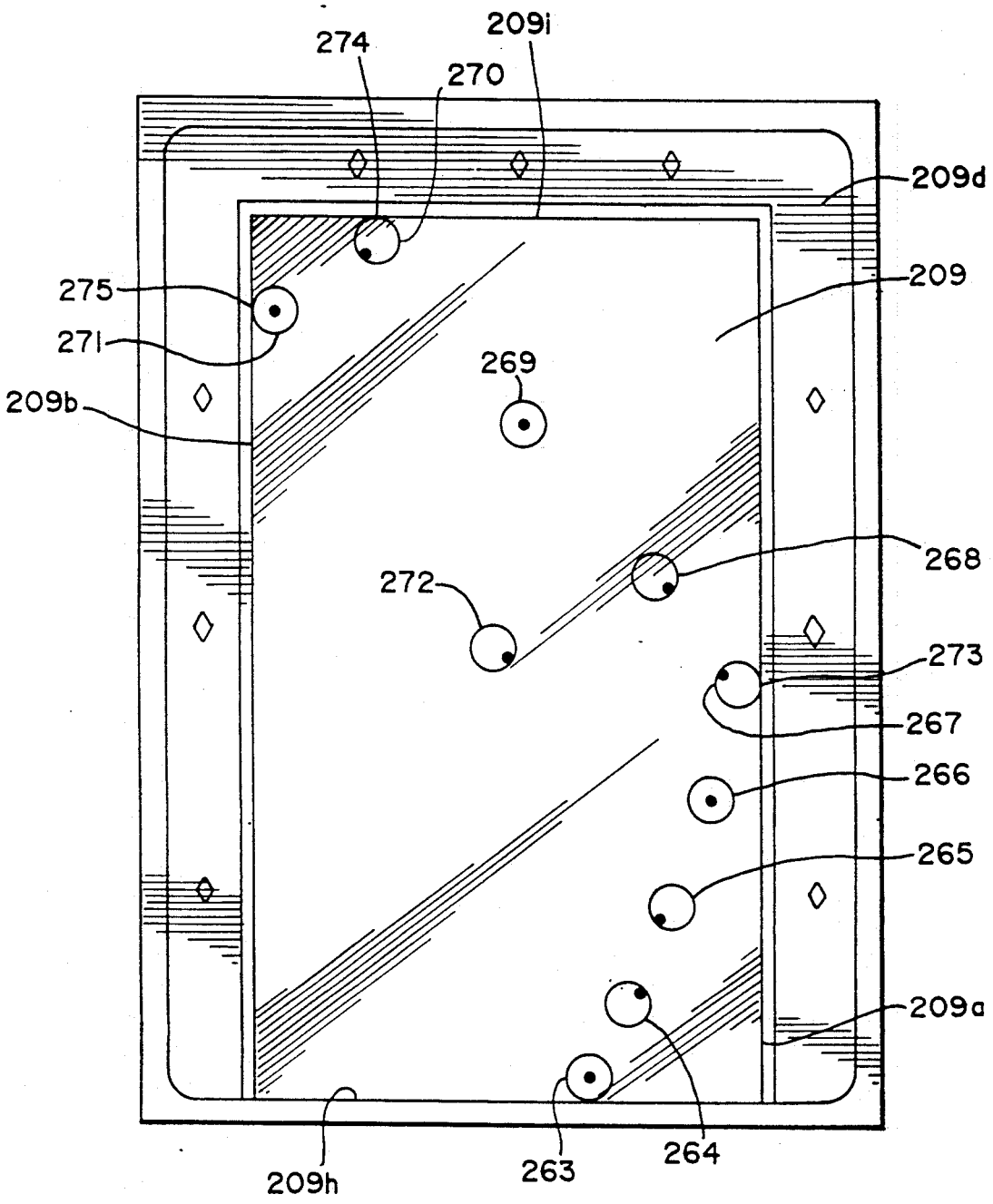
FIG. 10 is an illustration of a typical sequence of cue ball displays on a video monitor.

FIG. 10 is an illustration of a typical sequence of cue ball displays on a video monitor. A pool table 209 is represented and includes the area where the cue ball can be displayed, which is referred to as the playing surface. The playing surface is limited by the upper edge of the lower bumper (not visible) 209*h*, which is located at the bottom of the display. The playing surface is also limited by the right edge of the left bumper 209*b*, the left edge of the right bumper 209*a* and the lower edge of the top bumper 209*i*.

Cue ball representation 263 is the initial display of a cue ball at the bottom of the display. The initial horizontal position is right of center and the object movement data indicates a left to right path movement. The initial cue ball display has a centered red circle 215.

The next cue ball representation 264 follows the defined angle path of the object movement data. The next cue ball display in the sequence is used, which has the red circle in the upper right section of the cue ball 214.The cue ball representation 265 continues on the defined angle path of the object movement data. The next cue ball display in the sequence is used, which has the red circle in the lower left section of the cue ball 216. The next cue ball representation 266 follows the defined angle path of the object movement data. The next cue ball display in the sequence is used, which has the red circle centered in the cue ball 215.

Cue ball representation 267 is displayed so that it's right edge is next to the right bumper 209*a* 273. The coordinates for the cue ball were either at the bumper's left edge or into the bumper area 209*d*. By displaying the cue ball next to the bumper, the invention gives the visual effect of the cue ball momentarily being absorbed by the bumper's rubber-like material before rebounding away. The cue ball display sequence has now changed because the ball's path movement has gone to a right to left direction. The cue ball display is now one in which the red circle is located in the upper left area of the cue ball 212.

The next cue ball representation 268 follows the new defined angle path of the object movement data. The next cue ball display in the sequence is used, which has the red circle located in the lower right area of the cue ball 218.

The cue ball representation 269 continues on the defined angle path of the object movement data. The next cue ball display in the sequence is used, which has the red circle centered in the cue ball 215.

Cue ball representation 270 is displayed so that its top edge is next to the top bumper 209*i* 274. The coordinates for the cue ball were either at the bumper's top edge or into the bumper area 209*d*. The cue ball display sequence has now changed because the ball's path movement is now descending from the top of the table to the bottom. The cue ball display is now one in which the red circle is located in the lower left area of the cue ball 216.

Cue ball representation 271 is displayed so that it's left edge is next to the left bumper 209*b* 275. The coordinates for the cue ball were either at the bumper's right edge or into the bumper area 209*d*. By displaying the cue ball next to the bumper, the invention gives the visual effect of the cue ball momentarily being absorbed by the bumper's rubber-like material before rebounding away. The cue ball display sequence has now changed because the ball's path movement has gone to a left to right direction. The cue ball display is now one in which the red circle is centered in the cue ball 215.

The final cue ball representation 272 follows the new defined angle path of the object movement data. The next cue ball display in the sequence is used, which has the red circle located in the lower right area of the cue ball 218.

The number and position of the cue ball representations varies depending upon the speed of the cue ball, which is obtained in the object movement data.

The positioning of the movement indicator, which in the above description is a red circle, need not be limited to any set number of positions. For example, instead of having 3 different positions in a certain sequence, there could be 20 different positions.

The size of the movement indicator can be changed so that the cue ball looks more realistic. For instance, if the movement indicator is to be positioned at the upper edge of the object, only the bottom portion of the movement indicator would need to be shown.

A listing of the computer source code for effecting the operations as described herein, for a Motorola 68000 processor as used in an Atari ST computer, is as follows:

```
Copyright 1990, Daniel J. Dooley
* start up program

        .xref swh_ll,swh_lm,swh_lr,swh_mm,swh_hl,swh_hm,swh_hr
        .xref ssd_ll,ssd_lm,ssd_lr,ssd_mm,ssd_hl,ssd_hm,ssd_hr
        .xref msd_ll,swh_gn,ssd_gn

        .text
```

```
dbaseh  equ     $ffff8201       * display base high
dbasel  equ     $ffff8203       * display base low
ainit   equ     $a000           * line-a initialize
ahide_mouse equ $a00a           * hide the mouse
ashow_mouse equ $a009           * show the mouse
tester  equ     #16
*
*  Must be first object file in link statement
*
        move.l  a7,a5           * save a7 so we can get the base page address
        move.l  #ustk,a7        * set local stack
        move.l  4(a5),a5        * basepage address
        move.l  $c(a5),d0
        add.l   $14(a5),d0
        add.l   $1c(a5),d0
        add.l   #$100,d0        * skip los pageos baseos
        move.l  d0,-(sp)
        move.l  a5,-(sp)
        move    d0,-(sp)        * junk word
        move    #$4a,-(sp)
        trap    #1
        add.l   #12,sp
        clr.l   -(sp)           * our own stack please
        move.w  #$20,-(sp)      * get/set super mode
        trap    #1
        addq    #6,sp           * clean up
        move.l  d0,save_ssp     * save stack pointer

*
        jsr     main            * go to program
        move.l  save_ssp,-(sp)  * put back
        move.w  #$20,-(sp)      * you know
        trap    #1
        addq    #6,sp           * clean up

        move.l  mem_ret,-(sp)   * return the block to gem
        move.w  #$49,-(sp)
        trap    #1              * go do it
        addq    #6,sp           * clean up

        move.l  #0,-(a7)        * back to gemdos
        trap    #1


main:
        jsr     set_screen              * set up the screen
        jsr     get_screen              * go get the 2 screen locations
        move.w  #0,page_num             * set first page
        move.w  #3,d1
        move.w  d1,dotrefresh
        move.w  d1,path_numb
        jsr     page_flip               * for initial draw routine
        jsr     clr_scr                 * clear the screens
```

```
mainct:
        jsr     getinfo                 * get input from Parallel Port
        move.w  speed2,d0
        cmp.w   #1,d0                   * if speed2 = 0, then, error happened
        beq     cntmnexit               *       return to operating system
        jsr     draw_init               * draw the shapes once
mloop1:
        move.l  #swh_gn,shap_address
        jsr     balldbk                 * set the params
        jsr     shap_draw               * go draw the new shape
        jsr     page_flip               * flip the page
        jsr     waitblank               * wait for a while
        move.l  #swh_gn,shap_address
        jsr     ballebk                 * set the params
        jsr     shap_erase              * go erase the old shape

        jsr     ball_d_set              * set the params
        jsr     shap_draw               * go draw the new shape
        jsr     page_flip               * flip the page
        jsr     wait                    * wait for a while
        jsr     ball_e_set              * set the params
        jsr     shap_erase              * go erase the old shape

        move.w  xincr,d0                * if xincr >= 6, change dot every time
        cmp.w   #6,d0
        bge     changedot3
        move.w  path_numb,d1            * we are going to draw for path_numb
        dbra    d1,beforechange         * times, then we increase speed
        move.w  dotrefresh,d1           *   first, we'll restore path_numb
        move.w  d1,path_numb
changedot3:
        move.w  dotcnt,d0
        add.w   #4,d0
        cmp.w   #12,d0
        blt     afterdot3
        clr.l   d0

afterdot3:
        move.w  d0,dotcnt

*       the purpose of this next section is to slow down the ball & at the
*       same time, keep the ratio of xincr/yincr reasonably close.

        move.w  xincr,d0                * if xincr >= 6, then check if
        cmp.w   #6,d0                   *       pause increase s/b skipped
        blt     disregard
        move.w  path_numb,d1            * we are going to draw for path_numb
        dbra    d1,beforechange         * times, then we decrease speed
        move.w  dotrefresh,d1

disregard:
        move.l  tdelay,d0
        add.l   #$000014f0,d0           *       then add #$200 to delay
```

```
        move.l  d0,tdelay
        cmp.l   #$c000,d0
        bge     needkey
        bra     beforechange


beforechange:
        move.w  d1,path_numb            *  save path_numb

changnx:
        move.w  xdir,d0                 * take care of adjusting x, please
        tst.w   d0
        bne     xdirnotzero
        move.w  xincr,d1
        neg.w   d1                      * dir = top -> bottom, 2's compl d1
        jmp     changny

xdirnotzero:
        move.w  xincr,d1                *  put xincr into d1

changny:
        move.w  ydir,d0         * now it's y turn to be checked out
        tst.w   d0
        bne     ydirnotzero
        move.w  yincr,d2
        neg.w   d2                      * dir = right -> left, 2's compl d2
        jmp     afterchange

ydirnotzero:
        move.w  yincr,d2                        *  put yincr into d2

afterchange:
        move.w  shap1_y,d0
        add.w   d2,d0                   * some bits to y location
        move.w  d0,shap1_y              * do your stuff
        move.w  shap1_x,d0
        add.w   d1,d0
        move.w  d0,shap1_x              * do it this way for checking

check_topbmpr:
        cmp.w   #286,d0                 * close to top bumper
        ble     check_bottombmpr
        clr.l   d0                      * ball at top bumper, change dirx
        move.w  d0,xdir
        move.w  #286,d0                 * snug it up to bumper
        move.w  d0,shap1_x
        move.w  yincr,d0
        tst.w   d0
        beq     check_rightbmpr         * if ball hit straight, leave alone
        move.w  ydir,d0                 * if y dir=1    then:
        tst.w   d0                      *                       X
        beq     topyis0                 *                     x
        jsr     urll                    *                   x
        jmp     check_rightbmpr
```

```
topyis0:
        jsr     ullr
        jmp     check_rightbmpr

check_bottombmpr:
        move.w  shap1_x,d0
        cmp.w   #0,d0                   *  is that ball at the bottom bumper?
        bge     check_rightbmpr
        move.w  #1,d0                   *  yep, ball is bottomed out
        move.w  d0,xdir                 *       change dir x
        clr.l   d0
        move.w  d0,shap1_x              *  yah, I know, snug it up
        move.w  yincr,d0
        tst.w   d0
        beq     mloop1cnt               * if ball hit straight, leave alone
        move.w  ydir,d0                 * if y dir=1    then:
        tst.w   d0                      *               x
        beq     botyis0                 *                 x
        jsr     ullr                    *                   x
        jmp     mloop1cnt
botyis0:
        jsr     urll
        jmp     mloop1cnt

check_rightbmpr:
        move.w  shap1_y,d0
        cmp.w   #170,d0                 * is ball near right bumper?
        ble     check_leftbmpr
        clr.l   d0                      * damn, ball is at right bumper
        move.w  d0,ydir                 *       change  dir y
        move.w  #170,d0
        move.w  d0,shap1_y              * now snug it to right bumper
        move.w  xdir,d0                 * if x dir=1    then:
        tst.w   d0                      *                       x
        beq     ritxis0                 *                     x
        jsr     urll                    *                   x
        jmp     mloop1
ritxis0:
        jsr     ullr
        jmp     mloop1

check_leftbmpr:
        cmp.w   #16,d0                  * is ball near left bumper ?
        bge     mloop1
        move.w  #1,d0                   * yep, it's at the left bumper
        move.w  d0,ydir                 *       change  dir y
        move.w  #16,d0
        move.w  d0,shap1_y              * ok, snug it up real close
        move.w  xdir,d0                 * if x dir=1    then:
        tst.w   d0                      *               x
        beq     lftxis0                 *                 x
        jsr     ullr                    *                   x
        jmp     mloop1
lftxis0:
```

```
        jsr     urll
        jmp     mloop1

mloop1cnt:
        move.w  #2,-(sp)                * console
        move.w  #1,-(sp)                * status of above
        trap    #13
        addq    #4,sp
        tst.w   d0                      * zero = no characters
        bne     main_exit
        jmp     check_rightbmpr                 * keep going

needkey:
        jsr.    page_flip

        move.w  #$001b,-(sp)
        move.w  #2,-(sp)
        trap    #1
        addq.l  #4,sp
        move.w  #$0048,-(sp)
        move.w  #2,-(sp)
        trap    #1
        addq.l  #4,sp

        move.w  xincr,d7
        jsr     hexit

        move.w  yincr,d7
        jsr     hexit

        jsr     jspace
        jsr     jspace

        move.w  thisd1,d7
        jsr     hexit

        move.w  thisd2,d7
        jsr     hexit

        jsr     jspace
        jsr     jspace
        jsr     hexout

        jsr     page_flip

        move.w  #$001b,-(sp)
        move.w  #2,-(sp)
        trap    #1
        addq.l  #4,sp
        move.w  #$0048,-(sp)
        move.w  #2,-(sp)
        trap    #1
        addq.l  #4,sp
```

```
*       move.w  xincr,d7
*       move.w  #$31,d5
*       jsr     hexit

*       move.w  begy,d7
*       move.w  #$32,d5
*       jsr     hexit

*       move.w  yincr,d7
*       move.w  #$33,d5
*       jsr     hexit


        move.w  xincr,d7
        jsr     hexit

        move.w  yincr,d7
        jsr     hexit

        jsr     jspace
        jsr     jspace

        move.w  thisd1,d7
        jsr     hexit

        move.w  thisd2,d7
        jsr     hexit

        jsr     jspace
        jsr     jspace
        jsr     hexout

        move.l  #$296e69,d0     *for 5 seconds, s/b #$196e69
nkdelay:
        subi.l  #1,d0
        tst.l   d0
        bne     nkdelay         *  delay for five seconds, please
nk:
        move.w  #2,-(sp)                * console
        move.w  #1,-(sp)                * status of above
        trap    #13
        addq    #4,sp
        tst.w   d0                      * zero = no characters
        bne     main_exit
        jsr     aftersc                 *       clear both pages first
        jmp     mainct                  *  yes, so continue
main_exit:
        jsr     key_in                  * wait for a key
        cmpi.b  #13,d0                  * is key press carriage return ?
        bne     cntmnexit
        jsr     aftersc                 *       clear both pages first
        jmp     mainct                  *  yes, so continue
cntmnexit:
        lea     buffer,a1               *  set colors
```

```
        add.w   #2,a1
        move.w  #$777,(a1)
        move.l  a1,-(sp)
        move.w  #6,-(sp)
        trap    #14                     *  xbios routine
        addq.l  #6,sp

        move.b  page1_addr+1,d0
        move.b  d0,dbaseh               * set high byte back to normal
        move.b  page1_addr+2,d0
        move.b  d0,dbasel               * set screen back to original

        dc.w    ashow_mouse             * line-a call to show the mouse again

        move.w  rez_save,-(sp)          * get the resolut              110
        move.l  #-1,-(sp)               * don't set anything else
        move.l  #-1,-(sp)
        move.w  #5,-(sp)                * set screen call
        trap    #14                     * do it
        add.l   #12,sp                  * clean up
        rts                             * return to caller

strait:                         *       we are going to make the ball go
        move.l  #swh,a0
        move.l  #swh_lm,(a0)+
        move.l  #swh_mm,(a0)+   *                       x
        move.l  #swh_hm,(a0)
        clr.l   d0
        move.l  d0,dotcnt               * initially, dotcnt = 0
        rts

urll:                           *       we are going to make the ball go
        move.l  #swh,a0
        move.l  #swh_lr,(a0)+
        move.l  #swh_mm,(a0)+   *                       x
        move.l  #swh_hl,(a0)
        clr.l   d0
        move.l  d0,dotcnt               * initially, dotcnt = 0
        rts

ullr:
        move.l  #swh,a0         *       we're makin that ball go
        move.l  #swh_ll,(a0)+   *               x
        move.l  #swh_mm,(a0)+
        move.l  #swh_hr,(a0)    *                       x
        clr.l   d0
        move.l  d0,dotcnt               * initially, dotcnt = 0
        rts


hexout:
        move.l  #sensor,a1
        add.l   #6,a1
        move.l  #3,d5
```

```
hex11:
        move.l  #1,d4
        move.b  (a1)+,d7
hex12:
        move.b  d7,d6
        lsr.w   #4,d6
        andi.w  #$f,d7
        asl.w   #4,d7

        addi.w  #$30,d6

        cmpi.w  #$39,d6
        bls     ok

        addi.w  #$27,d6
ok:
        move.w  d6,-(sp)
        move.w  #2,-(sp)
        trap    #1
        addq.l  #4,sp

        dbra    d4,hex12

        move.w  #$20,-(sp)
        move.w  #2,-(sp)
        trap    #1
        addq.l  #4,sp

        dbra    d5,hex11

        rts
hexit:
        move.l  #1,d4
hexit1:
        move.b  d7,d6
        lsr.w   #4,d6
        andi.w  #$f,d7
        asl.w   #4,d7

        addi.w  #$30,d6

        cmpi.w  #$39,d6
        bls     okok

        addi.w  #$27,d6
okok:
        move.w  d6,-(sp)
        move.w  #2,-(sp)
        trap    #1
        addq.l  #4,sp

        dbra    d4,hexit1

jspace:
```

```
        move.w  #$20,-(sp)
        move.w  #2,-(sp)
        trap    #1
        addq.l  #4,sp

        rts

*
*               GET INFO FROM PARALLEL PORT
*

getinfo:
        clr.w   speed2
        move.w  #0,d0                   *  beg x always equals 0
        move.w  d0,begx                 *    which is bottom of table
        move.w  #1,d0
        move.w  d0,xdir                 *  beginning x dir is always positive

        move.l  #sensor,a3
        move.w  #9,d3

skip6x:
        move.w  #130,d4
        move.w  #0,-(sp)        *  #0 = printer port
        move.w  #2,-(sp)        *  Function Number
        trap    #13
        add.l   #4,sp
        move.b  d0,(a3)+
littledel:
        dbra    d4,littledel
        dbra    d3,skip6x


contget:
        move.l  #sensor,a1
        add.w   #6,a1
        move.b  (a1)+,dir2
        move.b  (a1)+,dir1      *                       purposes
        clr.l   d1
        clr.l   d2
        clr.l   d3
        move.w  (a1),d3         * distance -> d3
        move.b  dir1,d1
        move.b  dir2,d2
        clr.w   begy
        clr.w   yincr
        clr.w   ydir
        clr.w   xincr

        divu.w  #12,d3          *  scale distance number by dividing by 12
        move.w  d3,xincr
```

```
        clr.l   d4              *  put dir2 into d4 before sending to
        move.b  dir2,d4         *       subroutine to determine y
        jsr     deter_y
        clr.l   d2
        move.b  d4,d2           * put result back into d2
        move.w  d2,begy         *       and also for begy

        clr.l   d4              *  put dir1 into d4 before sending to
        move.b  dir1,d4         *       subroutine to determine y

nowdty:
        jsr     deter_y
        clr.l   d1
        move.b  d4,d1           * put result back into d1
        cmp.w   d1,d2
        beq     put0inyincr     *  direction is straight
        blt     d1GRd2
        move.w  #1,ydir         *  d2 > d1, so ydir = 1 (dir=left->right)
        exg     d1,d2
        bra     findyincr

deter_y:
        cmp.w   #$68,d4         *   is ball in leftmost 2 inches ?
        blt     adjustleft      *       yes, then adjust
        cmp.w   #$98,d4         *   is ball in rightmost 2 inches ?
        bgt     adjustright     *       yes, then adjust

        sub.b   #$68,d4         *  ( d4 - #$68) * 2 + 36 = ynumber
        asl     #1,d4           *
        add.b   #36,d4
        rts                     *               finished

adjustleft:
        cmp.w   #$5d,d4         *  if it is less than 5d, then give it 16
        bge     notlb
        move.b  #16,d4
        rts
notlb:
        sub.b   #$5d,d4         *  ( d4 - #$5d) * 2 + 16 = ynumber
        asl     #1,d4           *
        add.b   #16,d4
        rts                     *               finished


adjustright:
        cmp.w   #$ab,d4         *  if it is greater than aa, then give it 170
        blt     notrb
        move.b  #170,d4
        rts
notrb:
        sub.b   #$98,d4         *  ( d4 - #$98) * 2 + 132 = ynumber
        asl     #1,d4           *
        add.b   #132,d4
        rts                     *               finished
```

```
put0inyincr:
        clr.w   yincr
        bra     yisfini
d1GRd2:
        clr.w   ydir            * d1 > d2, so ydir = 0 (dir=right->left)


findyincr:
        move.w  d2,thisd2
        move.w  d1,thisd1
        sub.w   d2,d1           * take xincr * #$100, divide by 12, * y# = yincr
        divu    #6,d1
        and.l   #$ff,d1
        asl.w   #8,d3           * d2 is the smaller of dir1 & dir2
        divu.w  #$0c,d3         *   now we will get a % which is
        and.l   #$ff,d3
        mulu.w  d1,d3           *    1 - ( dir_small [d2] / [d1] dir_large )
        add.w   #$80,d3         * round up, please
        lsr.w   #8,d3
        move.w  d3,yincr        * then multiply it with xincr for yincr #


yisfini:

        move.w  xincr,d0
        cmp.w   #48,d0
        ble     xincr_ok
        move.w  #2,xincr
xincr_ok:
        move.w  begy,d0
        cmp.w   #170,d0
        ble     begy_ok
        cmp.w   #16,d0
        bge     begy_ok
        move.w  #55,begy

begy_ok:
        move.w  yincr,d0
        cmp.w   #40,d0
        ble     yincr_ok
*       move.w  #5,yincr

yincr_ok:

        jsr     setdelay                *       start tdelay at #$2000
        move.w  yincr,d0
        tst.w   d0
        beq     begistrait              * if ball hit straight, leave alone
        move.w  ydir,d0                 * if y dir=1    then:
        tst.w   d0                      *               x
        beq     begyis0                 *                 x
        jsr     ullr                    *                   x
```

```
        jmp     begentryfini
begyis0:
        jsr     urll
        jmp     begentryfini

begistrait:
        jsr     strait

begentryfini:
        rts

badexit:
        move.w  #1,speed2
        rts

*
* draw the shape specified
*

shap_draw:
        clr.l   d0              * for divide unsigned
        move.w  x_loc,d0        * get x cooridinate
        divs.w  #16,d0          * number of shifts
        swap    d0              * remainder into word location
        move.w  d0,shift_num    * save shift number
        clr.w   d0              * get rid of it
        swap    d0              * get byte number
        mulu.w  #8,d0           * for plane bypass
        move.w  d0,byte_num     * store the varialble
        move.l  shap_address,a0 * get shapes address
        clr.l   d0              * long operation on it
        clr.l   d1              * ditto
        move.w  (a0)+,d1        * get byte of shapes width
        move.w  d1,shap_width   * get shapes width
        move.w  (a0)+,d0        * get shapes height
        move.w  d0,shap_height  * put shapes height
        mulu.w  d1,d0           * size of shape
        move.w  d0,shap_size    * save it
        move.l  a0,shap_address * set the shapes new address past w & h
        move.l  mask_address,a1 * get mask pointer
        move.l  shap_address,a2 * get shape pointer
        move.l  shap_back,a3    * get shapes background save
draw_loop:
        move.w  byte_num,d0     * get byte number
        move.w  d0,temp_byte    * we are going to mess with it
        move.l  page_addr,d0    * get screen location
        move.l  d0,screen_ptr   * put in screen pointer
        clr.l   d0              * clear for long operation
        move.w  y_loc,d0        * get y location
        mulu.w  #$a0,d0         * number of bytes across screen
        add.l   d0,screen_ptr   * add to screen pointer
        clr.l   d1              * long operation
        move.w  shap_width,d1   * get shapes width
        subq.w  #1,d1           * actually minus one for dbra
```

```
        move.l  screen_ptr,a0   * get screen pointer
        clr.l   d0              * to get word work as long
        move.w  temp_byte,d0    * into register
        add.l   d0,a0           * into address register
draw_line:
        clr.l   d0
        clr.l   d3              * so shifts get zero if needed
        move.w  (a0),d0
        move.w  d0,(a3)+        * save background
        move.w  (a1)+,d0        * get mask byte
        move.w  (a2)+,d3        * get shapes byte
        move.l  #8,d2           * subtract from zero
        sub.l   d1,d2
        divs    #4,d2
        swap    d2              * get the remainder
        clr.w   d2              * don't care about remainder
        swap    d2              * get back divided by
        tst     d2
        beq.s   no_shift        * if zero then don't get previous word
        swap    d0
        swap    d3
        move.w  #-10(a1),d0     * get previous byte
        move.w  #-10(a2),d3     * get previous byte here also
        swap    d0
        swap    d3              * ok now to shift the shape
no_shift:
        move.w  shift_num,d2    * get which shift to shift
        lsr.l   d2,d0           * shift for offset
        lsr.l   d2,d3           * this one also
        and.w   d0,d3           * shapes data with and shape
        not.w   d0              * not for and operation
        and.w   (a0),d0         * and it in the screens memory
        or.w    d3,d0           * or it with
        move.w  d0,(a0)+        * move into screen memory
        dbra    d1,draw_line    * subtract 1 from width
        move.w  y_loc,d0        * get y location
        addq.w  #1,d0           * add 1 to y location
        move.w  d0,y_loc        * put back y location
        move.w  shap_height,d0  * get shapes height
        subq.w  #1,d0
        move.w  d0,shap_height  * decrement shapes height
        dbra    d0,draw_loop    * go back to next scan line

        rts                     * return to caller

*
* erase the shape that is set up
*

shap_erase:
        clr.l   d0              * for divide unsigned
        move.w  x_loc,d0        * get x cooridinate
        divs.w  #16,d0          * number of shifts
        swap    d0              * remainder into word location
```

```
        clr.w   d0              * get rid of it
        swap    d0              * get byte number
        mulu.w  #8,d0           * for plane bypass
        move.w  d0,byte_num     * store the varialble
        move.l  shap_address,a0 * get shapes address
        clr.l   d0              * long operation on it
        clr.l   d1              * ditto
        move.w  (a0)+,d1        * get byte of shapes width
        move.w  d1,shap_width   * get shapes width
        move.w  (a0)+,d0        * get shapes height
        move.w  d0,shap_height  * put shapes height
        mulu.w  d1,d0           * size of shape
        move.w  d0,shap_size    * save it
        move.l  a0,shap_address * set the shapes new address past w & h
        move.l  shap_address,a2 * get shape pointer
        move.l  shap_back,a3    * get shapes background save
eras_loop:
        move.w  byte_num,d0     * get byte number
        move.w  d0,temp_byte    * we are going to mess with it
        move.l  page_addr,d0    * get screen location
        move.l  d0,screen_ptr   * put in screen pointer
        clr.l   d0              * clear for long operation
        move.w  y_loc,d0        * get y location
        mulu.w  #$a0,d0         * number of bytes across screen
        add.l   d0,screen_ptr   * add to screen pointer
        clr.l   d1              * long operation
        move.w  shap_width,d1   * get shapes width
        subq.w  #1,d1           * actually minus one for dbra
        move.l  screen_ptr,a0   * get screen pointer
        clr.l   d0              * to get word work as long
        move.w  temp_byte,d0    * into register
        add.l   d0,a0           * into address register
eras_line:
        clr.l   d0
        move.w  (a3)+,d0
        move.w  d0,(a0)+        * restore background
        dbra    d1,eras_line    * subtract 1 from width
        move.w  y_loc,d0        * get y location
        addq.w  #1,d0           * add 1 to y location
        move.w  d0,y_loc        * put back y location
        move.w  shap_height,d0  * get shapes height
        subq.w  #1,d0
        move.w  d0,shap_height  * decrement shapes height
        dbra    d0,eras_loop    * go back to next scan line

        rts                     * return to caller

key_in:
        move.w  #1,-(sp)        * console input
        trap    #1              * get keyboard input
        addq    #2,sp           * clean up
        rts
```

```
*
* clear the screen to 0's
*
clr_scr:

setdrive:                       *                                   270

        move.l  #0,-(sp)        * #0 = drive a
        move.w  #$0e,-(sp)      * Function Number
        trap    #1
        addq.l  #6,sp           * clean up the stack

opendrive:

        move.w  #00,-(sp)       * #0 = file read only
        move.l  #filename,-(sp) * filename is put on the stack
        move.w  #$3d,-(sp)      * Function Number
        trap    #1
        addq.l  #8,sp           * clean up the stack
        tst.w   d0
        bmi     main_exit       * error,  bail out
        move.w  d0,handle

readfile:

        move.l  #buffer,-(sp)   * address of the data buffer        290
        move.l  #32034,-(sp)    * read 32,034 bytes
        move.w  handle,-(sp)
        move.w  #$3f,-(sp)      * Function Number
        trap    #1
        add.l   #12,sp          * clean up the stack
        tst.l   d0
        bmi     main_exit       * error,  bail  out

closefile:

        move.w  handle,-(sp)    * filename is put on the stack
        move.w  #$3e,-(sp)      * Function Number
        trap    #1
        addq.l  #4,sp           * clean up the stack

setcolor:

        lea     buffer,a1
        add.w   #2,a1
*       move.w  #$00,(a1)
        move.l  a1,-(sp)
        move.w  #6,-(sp)
        trap    #14             * xbios routine
        addq.l  #6,sp

aftersc:
        movea.l page2_addr,a1
        movea.l page1_addr,a0   * address of screen memory
```

```
        lea     buffer,a2
        move.w  #0,d1
        move.w  #$1fff,d0       * number of longs to clear

clr_loop:                       *                                   310
        move.l  34(a2,d1),(a0)+ * move long in there
        move.l  34(a2,d1),(a1)+ * move long in there
        add.w   #04,d1
        dbra    d0,clr_loop     * until all finished
        rts



*
* draw_init initializes the shapes on the screen for page-flipping
*
draw_init:
*       move.l  #swh_mm,swh             initial set up
*       move.l  #msd_mm,msd
        move.w  begx,shap1_x            * x cooridinate
        move.w  begy,shap1_y            * y cooridinate
        move.w  begx,shap1_ox           * x old cooridinate
        move.w  begy,shap1_oy           * y old cooridinate
        move.l  #swh_lm,shap_address    * shapes address
        move.l  #msd_ll,mask_address    * masks address -> variable
        move.l  #sbk1,shap_back         * shapes background storage
        move.w  shap1_x,x_loc           * x cooridinate
        move.w  shap1_y,y_loc           * y cooridinate
        jsr     shap_draw               * draw the shape
        jsr     page_flip               * flip the page number
        rts

*
* get_screen gets the screens and puts in locations
*
get_screen:

        move.w  #2,-(sp)                * get physical base of screen
        trap    #14                     * trap routine
        addq    #2,sp                   * clean up
        move.l  d0,page1_addr           * save address
        move.l  #$8100,-(sp)            * want 8000 bytes of memory
        move.w  #$48,-(sp)              * Malloc memory
        trap    #1                      * give it to me
        addq    #6,sp                   * clean up
        move.l  d0,mem_ret              * save for clean up
        move.l  d0,d1                   * into temporary variable
        and.l   #$ff,d1                 * get rid of rest
        move.l  #0,d2                   * what to subtract from
        sub.l   d1,d2                   * do it now
        and.l   #$ff,d2                 * only want the byte
        add.l   d2,d0                   * now we are on 512 byte boundary
        move.l  d0,page2_addr           * set it to that
        rts
```

```
*
* set_screen sets the screen locations
*
set_screen:
        dc.w    ainit                   * initialize a line
        dc.w    ahide_mouse             * hide the sucker
        move.w  #4,-(sp)                * get rez call
        trap    #14                     * get the sucker
        addq    #2,sp
        move.w  d0,rez_save             * save the resolution
        clr.w   -(sp)                   * low rez
        move.l  #-1,-(sp)               * don't set anything else
        move.l  #-1,-(sp)
        move.w  #5,-(sp)                * set screen call
        trap    #14                     * do it
        add.l   #12,sp                  * clean up
        rts
*
* page_flip flips over to the other page operations are done on page not
* showing.
*
page_flip:
*       move.w  #37,-(sp)       *  wait for next picture return
*       trap    #14
*       addq.l  #2,sp
        eori.w  #1,page_num             * next page
        move.w  page_num,d0             * get the page number
        tst.w   d0                      * zero or one?
        beq     page1_sel
        move.l  page1_addr,d0           * get address of page number 1
        move.l  d0,page_addr            * move into the base page number
        move.b  page2_addr+1,d0         * high byte of page
        move.b  d0,dbaseh               * move into display base high
        move.b  page2_addr+2,d0         * get next byte
        move.b  d0,dbasel               * actually middle
        bra     page_rt
page1_sel:
        move.l  page2_addr,d0           * get address of page number 2
        move.l  d0,page_addr            * move into the base page number
        move.b  page1_addr+1,d0         * high byte of page
        move.b  d0,dbaseh               * move into display base high
        move.b  page1_addr+2,d0         * get next byte
        move.b  d0,dbasel               * actually middle
page_rt:
        rts

*
* ball_d_set sets up the ball parameters for draw
*
ball_d_set:
        move.w  dotcnt,d0
        move.l  #swh,a1
        move.l  0(a1,d0),shap_address
```

```
balldbk:
        move.l  #msd_ll,mask_address    * masks address -> variable
        tst.w   page_num                * is page number zero
        bne     db_p2on
        move.l  #sbk1,shap_back         * shapes background storage
        bra     db_p1on
db_p2on:
        move.l  #sbk2,shap_back         * shapes background storage
db_p1on:
        move.w  shap1_x,x_loc           * x cooridinate
        move.w  shap1_y,y_loc           * y cooridinate
        rts

*
* ball_e_set sets up the ball parameters for erase
*
ball_e_set:
        move.w  dotcnt,d0
        move.l  #swh,a1
        move.l  0(a1,d0),shap_address
ballebk:
        move.l  #msd_ll,mask_address
        tst.w   page_num                * is page number zero
        bne     eb_p1on
        move.l  #sbk2,shap_back         * shapes background storage
        bra     eb_p2on
eb_p1on:
        move.l  #sbk1,shap_back         * shapes background storage
eb_p2on:
        move.w  shap1_ox,x_loc          * x cooridinate
        move.w  shap1_oy,y_loc          * y cooridinate
        move.w  shap1_x,shap1_ox        * new x to old x pointer
        move.w  shap1_y,shap1_oy        * same here
        rts

*
* wait for a while and do nothing
*
setdelay:
        move.l  #$2000,d0                       * 50 full containers
        move.l  d0,tdelay
        move.l  d0,bdelay
        rts

wait:
        move.l  tdelay,d0               * put tdelay into d0
wloop1:
        dbra    d0,wloop1               * empty container slowly
        rts

waitblank:
        move.l  bdelay,d0               * put tdelay into d0

wloopb1:
```

```
        dbra    d0,wloopb1              * empty container slowly
        rts

        .bss
        .even
        .ds.l   256
ustk:   .ds.l   1
*
        .data
        .even

save_ssp:
        ds.l    1               * save for super stack pointer

ret_save:
        ds.l    1               * return address save

        .even
bdelay:
        ds.l    1

buffer:
        ds.b    32034

        .even
filename:
        dc.b    'PL1.PI1',0

        .even
handle:
        ds.w    1

shap1_x:
        ds.w    1
shap1_y:
        ds.w    1               * shape 1's x and y storage

shap1_ox:
        ds.w    1
shap1_oy:
        ds.w    1               * shape 1's x and y storage

x_loc:  ds.w    1               * x and y storage for shapedraw
y_loc:  ds.w    1

shap_size:                      * size into shape
        ds.w    1
shap_width:                     * shapes width in bytes
        ds.w    1
shap_height:                    * shapes height in bytes
        ds.w    1

shift_num:                      * which shift we need
        ds.w    1
```

```
o_e_test:                   * odd-even test bit
        ds.w    1
byte_num:                   * byte number we are on
        ds.w    1
temp_byte:                  * temporary byte number
        ds.w    1
temp_o_e:                   * temporary odd even test
        ds.w    1

shap_address:               * shapes address
        ds.l    1
mask_address:
        ds.l    1
shap_back:                  * shapes background address
        ds.l    1

screen_ptr:                 * ptr to screen memory
        ds.l    1

page_num:                   * current page number
        ds.w    1

page_addr:                  * page ptr to screen memory
        ds.l    1

page1_addr:                 * page 1's location
        ds.l    1

page2_addr:
        ds.l    1           * page 2's location

mem_ret:                    * memory unallocate save
        ds.l    1

path_numb:                  * path number
        ds.w    1

rez_save:                   * resolution save
        ds.w    1

swh:
        ds.l    3           * address pointer to shape's width & height

ssd:
        ds.w    1           * address pnter to current shape's info

tdelay:
        ds.l    1

msd:
        ds.l    3           * address pnter to current shape's mask info

begx:
```

```
        ds.w    1               * beginning value of shape's x location

begy:
        ds.w    1               *   "       "   "   "   y   "

xdir:
        ds.w    1               *

ydir:
        ds.w    1               *

xincr:
        ds.w    1               *

yincr:
        ds.w    1               *

speed:
        ds.w    1               *  value added to delay after every movement

speed1:
        ds.w    1

speed2:
        ds.w    1
loopcntr:
        ds.w    1               *  # of times ball is moved  -  for testing

    sbk1:
        ds.w    $8*$F           ; shapes storage page 1

    sbk2:
        ds.w    $8*$F           ; shape storage page 2

dotrefresh:
        ds.w    1

dotcnt:
        ds.l    1

s1npath:
        dc.w    48              * number of path cells

thisd1:
        ds.w    1

thisd2:
        ds.w    1

sensor:
        ds.b    10

dir1:
        ds.b    1
```

```
dir2:
        ds.b    1

        .end
```

A source code representation of cue balls with the orientation indicator at various positions such as indicated in FIG. 7, and usable with the foregoing source code, is as follows:

```
Copyright 1990, Daniel J. Dooley
        .globl swh_ll,swh_lm,swh_lr,swh_mm,swh_hl,swh_hm,swh_hr
        .globl ssd_ll,ssd_lm,ssd_lr,ssd_mm,ssd_hl,ssd_hm,ssd_hr
        .globl msd_ll,msd_lm,msd_lr,msd_mm,msd_hl,msd_hm,msd_hr

        .even
*       Red mark Lower Left

    swh_ll:
        dc.w    $0008,$000F

    ssd_ll:
        dc.w    $07F0,$07F0,$07F0,$07F0
        dc.w    $0000,$0000,$0000,$0000
        dc.w    $180C,$180C,$180C,$180C
        dc.w    $0000,$0000,$0000,$0000
        dc.w    $3802,$2002,$2002,$2002
        dc.w    $0000,$0000,$0000,$0000
        dc.w    $7C01,$4001,$4001,$4001
        dc.w    $0000,$0000,$0000,$0000
        dc.w    $7C01,$4001,$4001,$4001
        dc.w    $0000,$0000,$0000,$0000
        dc.w    $BC00,$8000,$8000,$8000
        dc.w    $8000,$8000,$8000,$8000
        dc.w    $9800,$8000,$8000,$8000
        dc.w    $8000,$8000,$8000,$8000
        dc.w    $8000,$8000,$8000,$8000
        dc.w    $8000,$8000,$8000,$8000
        dc.w    $8000,$8000,$8000,$8000
        dc.w    $8000,$8000,$8000,$8000
        dc.w    $8000,$8000,$8000,$8000
        dc.w    $8000,$8000,$8000,$8000
        dc.w    $4001,$4001,$4001,$4001
        dc.w    $0000,$0000,$0000,$0000
        dc.w    $4001,$4001,$4001,$4001
        dc.w    $0000,$0000,$0000,$0000
        dc.w    $2002,$2002,$2002,$2002
        dc.w    $0000,$0000,$0000,$0000
        dc.w    $180C,$180C,$180C,$180C
        dc.w    $0000,$0000,$0000,$0000
        dc.w    $07F0,$07F0,$07F0,$07F0
        dc.w    $0000,$0000,$0000,$0000

*

    msd_ll:
```

```
    dc.w    $07F0,$07F0,$07F0,$07F0
    dc.w    $0000,$0000,$0000,$0000
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*     Red Mark Lower Middle

swh_lm:
    dc.w    $0008,$000F

ssd_lm:
    dc.w    $07F0,$07F0,$07F0,$07F0
    dc.w    $0000,$0000,$0000,$0000
    dc.w    $180C,$180C,$180C,$180C
    dc.w    $0000,$0000,$0000,$0000
    dc.w    $2002,$2002,$2002,$2002
    dc.w    $0000,$0000,$0000,$0000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $8000,$8000,$8000,$8000
    dc.w    $8000,$8000,$8000,$8000
    dc.w    $F800,$8000,$8000,$8000
    dc.w    $8000,$8000,$8000,$8000
    dc.w    $F800,$8000,$8000,$8000
    dc.w    $8000,$8000,$8000,$8000
    dc.w    $F800,$8000,$8000,$8000
```

```
    dc.w    $8000,$8000,$8000,$8000
    dc.w    $8000,$8000,$8000,$8000
    dc.w    $8000,$8000,$8000,$8000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $2002,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*

msd_lm:
    dc.w    $07F0,$07F0,$07F0,$07F0
    dc.w    $0000,$0000,$0000,$0000
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*   Red Mark Lower Right

swh_lr:
    dc.w    $0008,$000F

ssd_lr:
```

```
    dc.w    $07F0,$07F0,$07F0,$07F0
    dc.w    $0000,$0000,$0000,$0000
    dc.w    $180C,$180C,$180C,$180C
    dc.w    $0000,$0000,$0000,$0000
    dc.w    $2002,$2002,$2002,$2002
    dc.w    $0000,$0000,$0000,$0000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $9800,$8000,$8000,$8000
    dc.w    $8000,$8000,$8000,$8000
    dc.w    $7C01,$4001,$4001,$4001
    dc.w    $0000,$0000,$0000,$0000
    dc.w    $7C01,$4001,$4001,$4001
    dc.w    $0000,$0000,$0000,$0000
    dc.w    $3802,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*

msd_lr:
    dc.w    $07F0,$07F0,$07F0,$07F0
    dc.w    $0000,$0000,$0000,$0000
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
```

```
    dc.w    $8000,$8000,$8000,$8000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*   YELLOW CUE BALL W/ MIDDLE RED SPOT

swh_mm:
    dc.w    $0008,$000F

ssd_mm:
    dc.w    $07F0,$07F0,$07F0,$07F0
    dc.w    $0000,$0000,$0000,$0000
    dc.w    $180C,$180C,$180C,$180C
    dc.w    $0000,$0000,$0000,$0000
    dc.w    $2002,$2002,$2002,$2002
    dc.w    $0000,$0000,$0000,$0000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $8180,$8000,$8000,$8000
    dc.w    $8000,$8000,$8000,$8000
    dc.w    $83C0,$8000,$8000,$8000
    dc.w    $8000,$8000,$8000,$8000
    dc.w    $83C0,$8000,$8000,$8000
    dc.w    $8000,$8000,$8000,$8000
    dc.w    $83C0,$8000,$8000,$8000
    dc.w    $8000,$8000,$8000,$8000
    dc.w    $8180,$8000,$8000,$8000
    dc.w    $8000,$8000,$8000,$8000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $2002,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*   Mask Middle Red Spot

msd_mm:
    dc.w    $07F0,$07F0,$07F0,$07F0
    dc.w    $0000,$0000,$0000,$0000
```

```
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*   Red Mark High Left

swh_hl:
    dc.w    $0008,$000F

ssd_hl:
    dc.w    $07F0,$07F0,$07F0,$07F0
    dc.w    $0000,$0000,$0000,$0000
    dc.w    $180C,$180C,$180C,$180C
    dc.w    $0000,$0000,$0000,$0000
    dc.w    $200E,$2002,$2002,$2002
    dc.w    $0000,$0000,$0000,$0000
    dc.w    $401F,$4001,$4001,$4001
    dc.w    $0000,$0000,$0000,$0000
    dc.w    $401F,$4001,$4001,$4001
    dc.w    $0000,$0000,$0000,$0000
    dc.w    $800C,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
```

```
    dc.w    $8000,$8000,$8000,$8000
    dc.w    $8000,$8000,$8000,$8000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $2002,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*

msd_hl:
    dc.w    $07F0,$07F0,$07F0,$07F0
    dc.w    $0000,$0000,$0000,$0000
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*   Red Mark High Middle

swh_hm:
    dc.w    $0008,$000F

ssd_hm:
    dc.w    $07F0,$07F0,$07F0,$07F0
```

```
    dc.w    $0000,$0000,$0000,$0000
    dc.w    $180C,$180C,$180C,$180C
    dc.w    $0000,$0000,$0000,$0000
    dc.w    $2002,$2002,$2002,$2002
    dc.w    $0000,$0000,$0000,$0000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $8006,$8000,$8000,$8000
    dc.w    $8000,$8000,$8000,$8000
    dc.w    $800F,$8000,$8000,$8000
    dc.w    $8000,$8000,$8000,$8000
    dc.w    $800F,$8000,$8000,$8000
    dc.w    $8000,$8000,$8000,$8000
    dc.w    $800F,$8000,$8000,$8000
    dc.w    $8000,$8000,$8000,$8000
    dc.w    $8006,$8000,$8000,$8000
    dc.w    $8000,$8000,$8000,$8000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $2002,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*

msd_hm:
    dc.w    $07F0,$07F0,$07F0,$07F0
    dc.w    $0000,$0000,$0000,$0000
    dc.w    $1FFC,$1FFC,$1FFC,$1FFC
    dc.w    $0000,$0000,$0000,$0000
    dc.w    $3FFE,$3FFE,$3FFE,$3FFE
    dc.w    $0000,$0000,$0000,$0000
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
    dc.w    $FFFF,$FFFF,$FFFF,$FFFF
    dc.w    $8000,$8000,$8000,$8000
```

```
    dc.w    $7FFF,$7FFF,$7FFF,$7FFF
    dc.w    $0000,$0000,$0000,$0000
    dc.w    $7FFF,$7FFF,$7FFF,$7FFF
    dc.w    $0000,$0000,$0000,$0000
    dc.w    $3FFE,$3FFE,$3FFE,$3FFE
    dc.w    $0000,$0000,$0000,$0000
    dc.w    $1FFC,$1FFC,$1FFC,$1FFC
    dc.w    $0000,$0000,$0000,$0000
    dc.w    $07F0,$07F0,$07F0,$07F0
    dc.w    $0000,$0000,$0000,$0000

*   Red Mark High Right

swh_hr:
    dc.w    $0008,$000F

ssd_hr:
    dc.w    $07F0,$07F0,$07F0,$07F0
    dc.w    $0000,$0000,$0000,$0000
    dc.w    $180C,$180C,$180C,$180C
    dc.w    $0000,$0000,$0000,$0000
    dc.w    $2002,$2002,$2002,$2002
    dc.w    $0000,$0000,$0000,$0000
    dc.w    $4001,$4001,$4001,$4001
    dc.w    $0000,$0000,$0000,$0000
    dc.w    $4001,$4001,$4001,$4001
    dc.w    $0000,$0000,$0000,$0000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $8000,$8000,$8000,$8000
    dc.w    $800C,$8000,$8000,$8000
    dc.w    $8000,$8000,$8000,$8000
    dc.w    $401F,$4001,$4001,$4001
    dc.w    $0000,$0000,$0000,$0000
    dc.w    $401F,$4001,$4001,$4001
    dc.w    $0000,$0000,$0000,$0000
    dc.w    $200E,$2002,$2002,$2002
    dc.w    $0000,$0000,$0000,$0000
    dc.w    $180C,$180C,$180C,$180C
    dc.w    $0000,$0000,$0000,$0000
    dc.w    $07F0,$07F0,$07F0,$07F0
    dc.w    $0000,$0000,$0000,$0000

*

msd_hr:
    dc.w    $07F0,$07F0,$07F0,$07F0
    dc.w    $0000,$0000,$0000,$0000
```

```
dc.w    $1FFC,$1FFC,$1FFC,$1FFC
dc.w    $0000,$0000,$0000,$0000
dc.w    $3FFE,$3FFE,$3FFE,$3FFE
dc.w    $0000,$0000,$0000,$0000
dc.w    $7FFF,$7FFF,$7FFF,$7FFF
dc.w    $0000,$0000,$0000,$0000
dc.w    $7FFF,$7FFF,$7FFF,$7FFF
dc.w    $0000,$0000,$0000,$0000
dc.w    $FFFF,$FFFF,$FFFF,$FFFF
dc.w    $8000,$8000,$8000,$8000
dc.w    $FFFF,$FFFF,$FFFF,$FFFF
dc.w    $8000,$8000,$8000,$8000
dc.w    $FFFF,$FFFF,$FFFF,$FFFF
dc.w    $8000,$8000,$8000,$8000
dc.w    $FFFF,$FFFF,$FFFF,$FFFF
dc.w    $8000,$8000,$8000,$8000
dc.w    $FFFF,$FFFF,$FFFF,$FFFF
dc.w    $8000,$8000,$8000,$8000
dc.w    $7FFF,$7FFF,$7FFF,$7FFF
dc.w    $0000,$0000,$0000,$0000
dc.w    $7FFF,$7FFF,$7FFF,$7FFF
dc.w    $0000,$0000,$0000,$0000
dc.w    $3FFE,$3FFE,$3FFE,$3FFE
dc.w    $0000,$0000,$0000,$0000
dc.w    $1FFC,$1FFC,$1FFC,$1FFC
dc.w    $0000,$0000,$0000,$0000
dc.w    $07F0,$07F0,$07F0,$07F0
dc.w    $0000,$0000,$0000,$0000

.end
```

A listing in hexadecimal of the digital data usable in conjunction with the foregoing source code to represent the pool table is included as Appendix A.

It will be understood that modifications and variations may be effected without departing from the spirit and scope of the novel concepts of this invention.

APPENDIX A (A listing in hexadecimal of the digital data usable in conjunction with the foregoing listed source code to represent the pool table)

Copyright 1990, Daniel J. Dooley

```
0000077707000060-0520000700500005-0555022200770030-0400070707700505
0000FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
```

```
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFBFFF4000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFDFFF2000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFF1FFFE000-FFFFFFFFFFFF0000
FFFFFFFFFFFF0000-FFFFFFFFFFFF0000-FFFFFFFFFFFF0000-FFFFFFFFFFFF0FC0
F03FFFFFFFFF0000-FFFFFFFFFFFF0000-FFFFFFFFFFFF0000-FFFFFFFFFFFF0000
FFFFFFFF8FFF7000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFBFFF4000-FFFFFFFFFFFF0000
FFFFFFFFFFFF0000-FFFFFFFFFFFF0000-FFFFFFFFFFFF0000-FFFFFFFFFFFF3FC0
C03FFFFFFFFF0000-FFFFFFFFFFFF0000-FFFFFFFFFFFF0000-FFFFFFFFFFFF0000
FFFFFFFFDFFF2000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFFFFF8
0007FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0006-FFF9EFFFFFFFE000-1FFFFFFFFFFFC000-3FFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0003-FFFCFFFFFFFFFFFE
0001FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF001F-FFE0FFFFFFFFF800-07FFFFFFFFFFC00-03FFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0003-FFFCFFFFFFFFFFFF
0000FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF007F-FF80FFFFFFFFF800-07FFFF80FFFFFF80-007F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF0007FFFF0007-FFF8FFFFFFFFFFFF
00000000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF00FFFFFF00FF-FF00FFFFFFFFFC00-03FFFFE0FFFFFFE0-001F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF0007FFFF0007-FFF8FFFFFFFFFFFF
00000000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF01FFFFFF01FF-FE00FFFFFFFFFE00-01FFFFE0FFFFFFE0-001F0000FFFF0000
```

```
FFFF0000FFFF0000-FFFF0000FFFF0000-FFFF0000FFFF0000-FFFF0000FFFF0000
FFFF0000FFFF0000-FFFF0000FFFF0000-FFFF0007FFFF0007-FFF8FFFF801FFFFF
00000000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF03FFFFFF03FF-FC00FFFFFFFFFE00-01FFFFF0FFFFFFF0-000F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF0007FFFE0007-FFF8FFFF0003FFFF
00000000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF07FFFFFF07FF-F800FFFFFFFFFC00-03FFFFF8FF87FFF8-00070000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF0007FFF80007-FFF8FFFF0000FFFF
00000000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF0FFFFC1F0FFF-F000FFFFFFFFFC00-03FFFFFFFF00FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0007FFFF-0000FFFFFFFFF800-07FFFFFFF800FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0003FFFF-0000FFFFFFFFF800-07FFFFFFF000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-0000FFFFFFFFF000-0FFFFFFFE000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-0000EFFFFFFFE000-1FFFFFFFE000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-0000CFFFFFFFC000-3FFFFFFFC000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-00008FFFFFFF8000-7FFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-00000FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFE0003FFFE-00010FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFEF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFF8F0070-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFF8F0070-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFF8F0070-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFDF0020-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFC0003FFFC-00030FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFE0003FFFE-00010FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-00000FFFFFFF0000-FFFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0001FFFF-00008FFFFFFF8000-7FFFFFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0003FFFF-0000CFFFFFFFC000-3FFFFFFFC000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0007FFFF-0000EFFFFFFFE000-1FFFFFFFE000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF000FFFFF-0000FFFFFFFFF000-0FFFFFFFF000FFFF-0000FFFF0000FFFF
0000FFFF0000FFFF-0000FFFF0000FFFF-0000FFFF0000FFFF-0000FFFF0000FFFF
```

```
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF001FFFFF-0000FFFFFFFFFF800-07FFFFFFFC00FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF0000FFFF-0000FFFF0000FFFF-0000FFFF0000FFFF-0000FFFF0000FFFF
0000FFFF007FFFFF-0000FFFFFFFFFF800-07FFFFF8FF07FFF8-00070000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF000FFFF0000F-FFF0FFFE0001FFFE
00010000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF0FFFFFFF0FFF-F000FFFFFFFFF800-07FFFFF0FFEFFFF0-000F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF000FFFF0000F-FFF0FFFE0003FFFE
00010000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF07FFFFFF07FF-F800FFFFFFFFF800-07FFFFE0FFFFFFE0-001F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF000FFFFC000F-FFF0FFFE0007FFFE
00010000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF03FFFFFF03FF-FC00FFFFFFFFF800-07FFFFC0FFFFFFC0-003F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF000FFFFF000F-FFF0FFFE003FFFFE
00010000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF01FFFFFF01FF-FE00FFFFFFFFFF000-0FFFFF80FFFFFF80-007F0000FFFF0000
FFFF0000FFFF0000-FFFF0000FFFF0000-FFFF0000FFFF0000-FFFF0000FFFF0000
FFFF0000FFFF0000-FFFF0000FFFF0000-FFFF000FFFFF000F-FFF0FFFEFFFFFFFE
00010000FFFF0000-FFFF0000FFFF0000-FFFF0000FFFF0000-FFFF0000FFFF0000
FFFF0000FFFF0000-FFFF0000FFFF0000-FFFF0000FFFF0000-FFFF0000FFFF0000
FFFF00FFFFFF00FF-FF00FFFFFFFFFE000-1FFFFFFFFFFFFF00-00FFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF000F-FFF0FFFFFFFFFFFC
0003FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF00FF-FF00FFFFFFFFFE000-1FFFFFFFFFFFFE000-1FFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0007-FFF8FFFFFFFFFFF8
0007FFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF000F-FFF0FFFFFFFF8000-7FFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0003-FFFCFFFFFFFFFFF0
000FFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFF7FFF8000-FFFFFFFFFFFF0000
FFFFFFFFFFFF0000-FFFFFFFFFFFF0000-FFFFFFFFFFFF0000-FFFFFFFFFFFF3FC0
C03FFFFFFFFF0000-FFFFFFFFFFFF0000-FFFFFFFFFFFF0000-FFFFFFFFFFFF0000
FFFFFFFFBFFF4000-FFFFFFFFFFFF0000-FFFFFFFFFFFF0000-FFFFFFFFFFFF0000
```

FFFFFFFFFFFF0000-FFFFFFFFFFFF0000-FFFFFFFFFFFF0000-FFFFFFFFFFFF0000
FFFFFFFFFFFF0000-FFFFFFFFFFFE0001-FFFFFFFF3FFFC000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFF1FFFE000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFF7FFF8000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFBFFF4000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFFFFFFFFFF0000-FFFFFFFFFFFF0000
FFFFFFFFFFFF0000-FFFFFFFFFFFF0000-FFFF

I claim:

1. A method of playing a game wherein a player manipulates a game object, the game including a computer and a display, comprising the steps of the player moving the object, detecting data representing characteristics of movement of the object including the speed corresponding to movement as a function of time of said object, supplying the data to the computer, generating from the data a series of indications which represent said object to determine a simulated outcome of the game, said indications being, generated sequentially, and being spaced from one another to indicate movement of said object through space, and including an orientation indicating portion which is so changed in position from one indication to another as to simulate rotation of said object during said movement through space, the change in position of said orientation indicating portion from one position to another being changed as a function of said speed data, and displaying the representations to simulate an outcome of the game.

2. A method of display according to claim 1 wherein said object is a round object having a center and wherein each indication includes a periphery-indicating portion which extends in an arc about said center to indicate the periphery of said object and wherein said orientation indicating portion is adjacent said periphery-indicating portion and subtends an angle with respect to the center of said round object which is substantially less than that subtended by said periphery-indicating portion.

3. A method according to claim 2, including the further step of providing a background indication to simulate a table which includes a flat surface on which said round object may roll and bumpers around said flat surface from which said round object may rebound after collision therewith.

4. A method according to claim 2, including the further step of providing a background indication to simulate a bowling lane.

5. A method according to claim 1, further including the steps of generating an indication of a structure in the path of indicated movement of said object, and generating indications of space and time which indicate a collision between said object and said structure and a change in the direction of indicated movement of said object which corresponds to a rebound of said object from said structure.

6. A method as defined in claim 5 wherein the position of said orientation indicating portion is so changed after said indicated collision as to indicate a change in said indicated rotation of said object which corresponds to said rebound of said object from said structure.

7. A method according to claim 6 wherein said series of indications represent an object in the form of a spherical object rolling over a surface in one direction before said collision and rolling over said surface in a different direction after said collision and wherein said change in indicated rotation of said object corresponds to the difference between said one direction and said different direction.

8. A method of playing a game wherein a player manipulates a game object, the game including a computer and a display, comprising the steps of the player moving the object, detecting data representing characteristics of movement of the object including position, direction and speed corresponding to an initial position, a direction of movement away from said initial position and an initial speed of movement away from said initial position, supplying the data to the computer, generating from the data a series of screen displays including indications which represent said object to determine a simulated outcome of the game, said indications being spaced from one another to indicate movement of said object through space, and including an orientation indicating portion which is so changed in position from one indication to another as to simulate rotation of said object during said movement through space, the distance between sequential positions of said object being gradually reduced to simulate deceleration of said object, and the change in position of said orientation indicating portion being changed as a function of the simulated deceleration of said object, and displaying the representations to simulate an outcome of the game.

9. A method as defined in claim 8, wherein said screen displays are generated at a certain frame rate, said method including the further steps of storing a limited number of groups of rotational position data usable for display of a corresponding limited number of sequential rotational positions of said object, and shifting from use of one of said groups of rotational position data to another at rate equal to said frame rate divided by a integer number which is determined as a function of the simulated speed of movement of the object.

* * * * *